US008218400B2

(12) United States Patent
Taylor et al.

(10) Patent No.: US 8,218,400 B2
(45) Date of Patent: Jul. 10, 2012

(54) CLOCK

(75) Inventors: John Crawshaw Taylor, Isle of Man (GB); Stewart Leonard Huxley, Cambridge (GB)

(73) Assignee: Fromanteel Limited, Santon, Isle of Man (GB)

( * ) Notice: Subject to any disclaimer, the term of this patent is extended or adjusted under 35 U.S.C. 154(b) by 903 days.

(21) Appl. No.: 12/091,563

(22) PCT Filed: Oct. 23, 2006

(86) PCT No.: PCT/GB2006/003938

§ 371 (c)(1),
(2), (4) Date: Oct. 27, 2008

(87) PCT Pub. No.: WO2007/049019

PCT Pub. Date: May 3, 2007

(65) Prior Publication Data

US 2009/0154298 A1 Jun. 18, 2009

(30) Foreign Application Priority Data

Oct. 25, 2005 (GB) ..... 0521765.8

(51) Int. Cl.
*G04B 19/20* (2006.01)
*G04B 19/02* (2006.01)
*G04C 17/02* (2006.01)

(52) U.S. Cl. ..... 368/77; 368/221; 368/233; 368/240

(58) Field of Classification Search ..... 368/62, 368/76, 77, 79, 221, 223, 233, 234, 239
See application file for complete search history.

(56) References Cited

U.S. PATENT DOCUMENTS

| | | | |
|---|---|---|---|
| 2,293,459 | A | 8/1942 | Ewing |
| 3,593,517 | A | 7/1971 | Knippler |
| 3,673,792 | A | 7/1972 | Scholz |
| 3,685,279 | A | 8/1972 | Scholz |
| 3,704,582 | A | 12/1972 | Wuthrich |
| 3,740,942 | A | 6/1973 | Wuthrich |
| 3,775,968 | A | 12/1973 | Tuetey |
| 3,955,354 | A | 5/1976 | Kilby et al. |
| 3,956,941 | A | 5/1976 | Faivre |
| 4,041,692 | A | 8/1977 | Marshino |
| 4,041,693 | A | 8/1977 | Bonsack |
| 4,122,665 | A | 10/1978 | Giger |

(Continued)

FOREIGN PATENT DOCUMENTS

| | | | |
|---|---|---|---|
| CH | 34632 | A | 5/1905 |

(Continued)

OTHER PUBLICATIONS

Internatinal Search Report for PCT/GB2006/003938 dated Apr. 27, 2007.

(Continued)

*Primary Examiner* — Vit Miska
(74) *Attorney, Agent, or Firm* — McCormick, Paulding & Huber LLP

(57) ABSTRACT

A clock comprising concentric rings of slots slits for indicating time by fully illuminating an appropriate one of the slots. Full illumination is propagated from one slot to an adjacent slot by causing all of the slots in a ring of slots to briefly light up sequentially, thus causing a flash of light to propagate around the ring of slots, thus more clearly showing passage of a second, a minute etc as the illumination was switched from the one slot to the adjacent slot.

40 Claims, 17 Drawing Sheets

U.S. PATENT DOCUMENTS

| | | | |
|---|---|---|---|
| 4,274,154 | A | 6/1981 | Dostoomian |
| 4,279,031 | A | 7/1981 | Dostoomian |
| 4,605,311 | A | 8/1986 | Loitz |
| 5,880,796 | A | 3/1999 | Sonoda et al. |
| 2003/0099159 | A1 | 5/2003 | Herbstman et al. |

FOREIGN PATENT DOCUMENTS

| | | | |
|---|---|---|---|
| CH | 360345 | | 2/1962 |
| DE | 2621042 | A1 | 11/1977 |
| DE | 3534243 | A1 | 3/1987 |
| DE | 3907873 | A1 | 11/1989 |
| DE | 89 11 276.8 | U1 | 8/1990 |
| DE | 9217623 | U1 | 2/1992 |
| DE | 10062933 | A1 | 7/2002 |
| EP | 0177440 | A1 | 4/1986 |
| EP | 1168112 | A1 | 1/2002 |
| GB | 448661 | A | 6/1936 |
| GB | 2204429 | A | 11/1988 |
| GB | 2 206 712 | A | 1/1989 |
| GB | 2394568 | A | 4/2004 |
| WO | 01/59530 | A1 | 8/2001 |

OTHER PUBLICATIONS

UK Search Report for GB 0521765.8 dated Jun. 30, 2006.

See Webpage: http//users.actcom.co.il/meccano/grasshop.html dated Jul. 1, 2002, entitled: “Grasshopper Escapement Long Case”.

CLOCK

CROSS REFERENCE TO RELATED APPLICATIONS

This application is entitled to the benefit of and incorporates by reference essential subject matter disclosed in International Patent Application No. PCT/GB2006/003938 filed on Oct. 23, 2006 and Great Britain Patent Application No. 0521765.8 filed Oct. 25, 2005.

FIELD OF THE INVENTION

The present invention relates to clocks and in particular to a novel form of clock.

According to a first aspect of the present invention there is provided a clock comprising a static surface with a number of relatively narrow apertures, each corresponding to a representation of an instant of time in a predetermined unit, and a rotatable shutter with a number of relatively narrow apertures, arranged so that light propagating through a selected one of the apertures in the rotatable shutter can also propagate through one of the apertures in the static surface so as to indicate said instant of time; wherein the number of apertures in the rotatable shutter differs from the number of apertures in the surface; and further comprising means for rotating the rotatable shutter from a position in which said one of the apertures in the rotatable shutter is in alignment with one of the apertures in the static surface to a position in which the same one of the apertures in the rotatable shutter is in alignment with an adjacent one of the apertures in the static surface when incrementing the instant of time indicated by one unit.

SUMMARY OF THE INVENTION

Thus one particular aperture in a rotatable shutter is arranged in alignment with a further aperture in a static shutter surface when displaying a particular unit of time, for example, a particular second, minute, quarter hour, hour, half day, day, week, month, moon phase and 'so on. The same aperture in the rotatable shutter is in alignment when the next unit of time, e.g. the next second or the next minute is displayed.

The apertures are preferably elongate, e.g. slits, although they could be of other shapes, e.g. circular holes.

Since seconds pass quickly, the rotatable shutter behind the static apertures will have to increment forward to the next static aperture with a travel time and pause period in total equating to one second. If for example the clock is controlled by an actual or a virtual seconds' pendulum, the pause to display the actual instant of time may only be the pause at the end of each swing of the pendulum. However, even though the pause is short and may only slightly longer than the transitory indication in other apertures, an observer can easily identify the particular second displayed.

It is preferred to index the 'minutes' rotatable shutter forward, as is conventional, as the 'seconds' shutter completes 60 seconds when indexing forward from indication 59 to 60 or 0 seconds. Similarly the 'hours' shutter should move forward to indicate the new hour concurrently with the both the 'seconds' shutter and the minutes' shutter index forward from 59 minutes and 59 seconds. This will be discussed again further below.

The preferred clock comprises a plurality of concentric rotatable shutters. These shutters may be independently driven, but preferably one of the shutters is driven, e.g. by the escapement, and drives one or more other of the shutters through a suitable mechanism.

This has been recognised to be advantageous in its own right and according to another aspect of the present invention therefore there is provided a clock comprising concentric rotatable shutters, means to drive a first said shutter, said first shutter driving at least one further shutter.

Since a second is the smallest moment of time normally displayed by a clock it is preferred that the escapement is coupled to, e.g. mounted to, the 'seconds' shutter whereby the intermittent rotation of the escapement wheel is transferred to the 'seconds' shutter.

Preferably means are provided for locking the non-moving shutter(s) during periods of non-movement. For example, a 'minutes' ring may be locked in a stationary position to display the current minute whilst the 'seconds' ring continues to be driven and displays the appropriate passing seconds. It is advantageous to lock the rotatable shutters behind the static apertures indicating minutes, hours, days, etc to prevent vibration moving the rotating slot out of alignment with the static aperture representing the particular minute, hour, or day etc displayed.

Preferably, therefore, the first shutter intermittently drives the at least one further shutter, which is preferably locked in position apart from when it is driven by the first shutter.

Preferably therefore, the first shutter is only brought into intermittent driving relationship with a further shutter. For example, the drive may be designed so that as a 'seconds' shutter is at its 59 second position, the 'minutes' shutter is brought into drive with it. The movement of the 'seconds' shutter to the 60 or 0 position also indexes the 'minutes' shutter to the next minute position. A similar mechanism could be applied to the 'hours' shutter. However, if it were to remain locked in position for throughout a whole hour, as the next hour was approached, an observer might be confused if the clock were to say remain on say the fourth hour right up to the $59^{th}$ minute and the $59^{th}$ second before moving onto the $5^{th}$ hour the next second. To mitigate this problem, it is advantageous to increment the hour shutter forward to display quarter hour intervals.

A shutter associated with the day of the week or the date of the month would be expected to change over at the stroke of midnight but preferably remains stationary for 23 hours 59 minutes and 59 seconds, locked into position.

In the preferred drive mechanism, the further shutter includes a ring gear that engages a gear wheel directly or indirectly driven by said first shutter.

Most preferably the gear wheel is driven by a further gear wheel which engages the first shutter.

The first shutter may be provided with teeth over a limited circumferential extent whereby drive is only transmitted to the further shutter(s) over a limited circumferential movement of the first shutter, thereby achieving the intermittent drive discussed above.

In a particularly preferred arrangement, the first shutter drives two further shutters, movement of the second further shutter, being controlled by movement of the first further shutter. This allows say both 'minutes' and 'hours' shutters to be driven off a 'seconds' shutter, with movement of the 'hours' shutter being controlled by the 'minutes' shutter.

Preferably therefore, the first further shutter is provided with means for selectively drivingly coupling said first shutter to said second further shutter. Said means may comprise a cam which at an appropriate rotational position engages a cam follower associated with the drive, causing said drive to engage. A person knowledgeable in the art will appreciate that the angular rotation for a seconds ring and a minutes ring is the same whereas the drive mechanism for a quarter hour or day of the week etc requires a different ratio.

The accuracy of time keeping of the preferred clock is dependent on the speed at which shutters influencing or determining the indicating of time rotate. In a preferred clock having a given number of apertures in a static surface or an outer face (which is visible to an observer) of the clock, the shutter preferably performs a full rotation in a period of time defined by the number of slots in the static surface or outer face multiplied by the unit of time represented by the slots in the outer face or static surface. For example, in a clock having sixty slots for indicating seconds in a static surface or outer face, a shutter associated with these sixty slots would perform on full rotation in a period defined by the unit of time indicated by the slots, namely seconds, multiplied by the number of slots in the static surface or front face, namely sixty slots. The shutter in question accordingly performs one full rotation once every minute.

From another aspect of the present invention there is therefore provided a clock comprising a static surface with a number of relatively narrow apertures each corresponding to a representation of an instant of time in a predetermined unit, and a rotatable shutter with a number of relatively narrow apertures arranged so that light propagating through at least one of the apertures in the shutter can also propagate through one of the apertures in the static surface in a substantially unattenuated manner, wherein the rotatable shutter is arranged to perform one full rotation in a period defined by the number of apertures in the static surface displaying the unit of time multiplied by the unit of time associated with the apertures in the static surface, and wherein the number of apertures in the static surface differs from the number of apertures in the rotatable shutter.

The clock is preferably arranged so that, in a process of rotating the rotatable shutter from alignment of an aperture in the rotatable shutter with an aperture in the static surface into alignment of the aperture in the shutter with an adjacent aperture in the static surface, all of the apertures in the static surface are sequentially aligned with a corresponding aperture in the shutter for a period of time. This sequential alignment lasts only for a very short period of time for each aperture, typically shorter than the period of time that is to be displayed divided by the number of apertures in the static surface (e.g. shorter than one sixtieth of a second in the case of a ring of apertures used for indicating seconds, when the ring of apertures comprises sixty apertures) and can be observed as a flash of light racing around the apertures in the static surface, starting from the aperture in the static surface that is in alignment with an aperture in the shutter at the beginning of the rotation of the rotatable shutter.

A similar effect can be produced in rings of apertures representing minutes, quarters of an hour, hours, day of the week etc.

The apertures in the static surface and the shutter preferably extend in a radial direction and are arranged in a circle. The pitch circle diameter of a circle in which the centre of the apertures in the static surface are arranged is preferably similar or substantially the same as the pitch circle diameter of the circle in which the apertures in the rotatable shutter are arranged, so that light propagating through apertures in the rotatable shutter can propagate through apertures in the static surface in a substantially unattenuated manner.

Preferably the width of each aperture, e.g. slit is less than the circumference at the inner edge of the apertures' pitch circle divided by the number of apertures squared. For example the width of each slit in a seconds' ring having 60 slits would be less than the circumference at the slits' inner diameter divided by 3600. This will ensure that each slit is spaced from its neighbour by more than 59 slit widths, thereby enabling the rotatable shutter to be incremented forward by 60 slit widths before the next slit comes into line again.

The number of apertures in the static surface is commonly twelve, forty-eight or sixty for representing hours, quarter hours, minutes and seconds, but other numbers of apertures such as seven, thirty one for other indications such as the day of the week or the date of the month etc can be used as necessary.

In a preferred embodiment, the number of apertures in the static surface differs from the number of apertures in the shutter by one to ensure that only one pair of apertures can align at any one time, with no harmonics also in line. The number of apertures in the shutter is accordingly preferably eleven, thirteen, forty-seven, forty-nine, fifty-nine or sixty-one, six or eight, thirty or thirty two etc. If the apertures in the shutter are one less than those in the static the ring of light will appear to revolve anti clockwise whereas with one more aperture the ring of light will appear to rotate clockwise with a conventional clockwise rotation of the ring.

In a preferred clock a light source is arranged behind the shutter. It will, however, be appreciated that arranging of such a light source is in no way limiting and the present invention could, for example, also be practised with no additional light source at all beyond incident and reflected light.

The static surface can be an external face of the clock. More preferably, however, the clock is provided with a separate outer face that may overlie the static surface. This front face preferably comprises apertures positioned so as to be aligned with the apertures in the static surface. Light propagating through the apertures in the static surface can therefore also propagate through the apertures in the front face.

The apertures in the outer face of the clock preferably accommodate light pipes for conveying light from an aperture in the static surface through the front face. The front face of the light pipe may form a continuous surface with the outer face of the clock, but preferably it protrudes above the adjacent surface. The front face of the light pipe is preferably shaped so as to enable light to be emitted and observed over a wide field of view, so that an observer does not need to be normal to the clock face read the time. The face may have a frosted appearance to improve this further.

The static aperture may be narrower than the aperture in the front face of the clock. Typically the static aperture is a rectangular slit whereas the aperture in the surface is preferably aesthetically shaped, for example a lenticular slot.

The rotatable shutter is preferably coupled to an escapement. The clock then further preferably comprises a pair of pallets and a pallet carrier for controlling the rotation of the escapement and thus the shutter ring. In a preferred clock therefore the shutter can be permitted to rotate by a given angle once every unit of time. For example, a shutter employed to display seconds can be permitted to rotate by six degrees once every second when the number of apertures in the static surface is sixty, so that one aperture in the rotatable shutter moves from alignment with a aperture in the static surface into alignment with an adjacent aperture in the static surface. The preferred drive mechanism will be described in greater detail later in the description.

Whereas the following description of the present invention concentrates on a particular well known clock escapement invented in the early eighteenth century by John Harrison and nicknamed the "grasshopper1" escapement, many of the features explained below equally apply to other escapements and could so be adapted by those skilled in the clockmaking art.

Prior art clocks employing pallets and pallet carriers can suffer from the disadvantage that pallets exceeding a certain mass can bounce against their positioning stops, hence coming out of alignment with and so losing contact with the escapement instead of remaining in contact with the escapement for the correct length of time. Great care has to be taken to mitigate this problem, even with small escapement wheels and lightweight pallets, for example by the use of special spring loaded stops and energy absorbent materials. However, in accordance with a further feature of this invention, this problem is overcome by the pallets being positively driven into and out of alignment with the escapement.

According to another aspect of the present invention, therefore, there is provided a clock comprising an escapewheel, a pair of pallets and a pallet carrier, wherein the pallets are arranged to be positively driven into and out of alignment with the escapewheel.

The preferred clock does therefore not suffer from the disadvantages above, as contrary to known pallet and escapement mechanisms, the movement of the pallets is positively controlled and does not rely on factors that may vary depending on the circumstances of use of the clock. Known clocks, for example rely on the pallets moving or accelerating towards the escapement under the influence of gravity. This acceleration may be dependent on the use or location of the clock and more importantly the condition of the oil and lubrication of the pallet bearings and accordingly the movement of the pallets may be so dependent. The preferred clock does not suffer from such dependency, as the pallets are positively driven and held in the correct alignment at all times. If gravity or springs are used to move the pallets there is an increasing small force trying to remove the pallet from alignment and contact with the escapement tooth as the angle of the pallet changes as the escapement tooth moves under its motive force. The pallets of a preferred clock can thus be held in a desired position, for example in alignment and engagement with the escapement tooth, for a desired period of time and subsequently be positively driven from this position.

Suitable means may be provided to urge the escapewheel teeth into contact with the pallets. One preferred mechanism will be described later in the specification.

In known clocks the pallet carrier is arranged to undergo an oscillating motion by being directly linked to the pendulum or balance wheel of the clock, thereby controlling the clock. The amplitude of oscillation of the pendulum or balance wheel is maintained by imparting a small impulse each oscillation. Thus the pendulum or balance wheel controls the period of the clock and is kept oscillating by virtue of the driving force of the clock. This has the disadvantage that any variation in the oil in the bearings affects the impulse to the pendulum or balance wheel which in turn affects the timekeeping. In turn any variation of the amplitude also affects the timekeeping.

In a clock the subject of a further aspect of the present invention the time base of the clock does not rely on a mechanical pendulum or balance wheel but used an independent time base oscillator. Preferably this consists of either the mains frequency or an electronic oscillator as the time base. This can be used to accurately drive a drive member which may be given the appearance of a pendulum or balance wheel, which is more accurate than using a free pendulum or balance wheel. This provides a mechanical clock with all the advantages of modern timekeeping, but with a mysterious and different clock mechanism that appears to be true mechanical clock.

From a further aspect therefore, the invention provides a clock comprising an escapement, a pair of pallets and a pallet carrier, wherein the movement of the pallets is controlled by an independent time base oscillator.

A motor for moving the pallets and/or the pallet carrier is further preferably provided. This motor can ensure continued operation of the preferred clock, irrespective of any energy losses caused, for example, by the contact between the pallets and the escapement.

According to another aspect of the present invention, therefore, there is provided a clock comprising an escapement, a pallet carrier, a pair of pallets and a motor for driving the escapement and the pallet carrier.

The motor is preferably a controllable motor such as a stepping motor. With such a motor not only may the motor run either forwards or backwards but also the speed of operation at any angular sector may be accurately controlled and it may be stopped as desired at an accurate position. Thus if the motor is being driven forward and is slowed as a pallet is about to be released, if the motor is stopped just before the point of release and then driven backwards, the pallet will not release from the escapewheel tooth and will then drive the escapewheel and hence the rotatable shutter backwards. As the positions of the pallets are positively and accurately controlled by the mechanism as the mechanism is driven backwards, the pallets will alternately engage and catch the escapewheel, allowing the clock to run backwards.

It will be appreciated by a person skilled in the art that it will be difficult to drive both the pallet carrier and the escapewheel directly and continuously. Whereas a crank drive mechanism could drive the pallet carrier and hence the pallets in such a manner, the escapewheel operates in a series of accelerations and decelerations, stopping momentarily between times. To accommodate these variations from uniform motion, the drive mechanism preferably includes a lost motion mechanism.

It will be further appreciated that the driving force on the escapewheel must always provide sufficient torque to keep the escapement wheel tooth in contact with the engaged pallet end as the escapement wheel is accelerated and decelerated.

The lost motion mechanism and torque are preferably provided by a low rate spring, such as a flat spiral spring. Typically the spring is pre-wound to the extent necessary to provide the torque. As the escapewheel is driven by the motor, the spring accommodates the different motions of the motor and the wheel. As the escapement wheel accelerates, the spring unwinds, driving the escapewheel. While the escapewheel is decelerating or stationary, however, the spring is wound up once more by the drive motor to provide the necessary torque for the next movement of the escapewheel. In one embodiment, particular clock it was found that sufficient torque could be provided by fifteen turns of a multi-turn flat spiral spring.

In this mode, the motor can be rotated at a fixed speed in a continuous manner despite the fact that the escapewheel driven by the motor is intermittently prevented from rotation by the pallets. Energy provided by the motor in periods in which the escapewheel is prevented from rotation is simply stored in the spring and used for rotating the escapewheel in periods in which the escapewheel is free to rotate.

This is a novel arrangement in its own right and accordingly in another aspect of the present invention there is provided a clock comprising a continuously rotating motor and a pallet controlled escapement driven by the motor but intermittently prevented from rotating by the pallets, and further comprising an energy storage device arranged between the motor and the escapement for sequentially storing driving energy produced by the motor and releasing said energy to drive the escapement.

In a preferred clock, a motor drives the pallet carrier and causes the pallet carrier to undergo an oscillating motion. The frequency of this oscillating motion is preferably determined by the drive speed of the motor, which is controlled by the external time base. It will be appreciated that this frequency at least in part determines the period of contact of the pallets with the escapement and thus the latter's movement.

The accuracy of time keeping can accordingly be adjusted by adjusting the drive speed of the motor as necessary from the external time base.

It has been recognised that this arrangement is advantageous in its own right and according to another aspect of the present invention there is provided a clock comprising an escapement, a pallet carrier, a pair of pallets and a motor, said motor driving the pallet carrier in an oscillating motion having a frequency determined by the drive speed of the motor.

The drive speed of the motor is in turn determined by an external time base.

In a preferred clock, the speed of the clock can freely be chosen within the bounds of the possible drive speeds of the motor and, where present, the limitations of the drive spring torque requirement. This permits precise adjustment of the clock's time keeping accuracy by controlling the drive speed of the motor. Thus the clock can be automatically controlled, for example, to gain an hour when the clocks go forward, by temporarily running the drive motor at a higher speed for a desired period (say a couple of hours) and likewise to lose an hour by temporarily slowing the drive motor down.

It has been recognised that the possibility of adjusting the drive speed of a motor driving a clock is of importance for the accuracy of time keeping of the clock. It has further been recognised that a clock that can be driven at various speeds lends itself to various ways of presenting the passage of time in unusual manners.

According to another aspect of the present invention therefore there is provided a clock comprising means for running the clock at least first and second, different speeds.

A preferred clock could, therefore, be run in two different modes. A first mode using, for example, the first speed can be used for accurate time keeping. In a second mode, however, the clock may be operated at a speed lower than the speed required for accurate time keeping, for example to simulate a slower passage of time. After such a simulation of a slower passage of time, the preferred clock can be operated at a speed faster than the speed required for accurate time keeping (for example in a further, third, mode), so that after a period of time the clock displays the correct time once more.

A clock comprising a motor further preferably comprises a microprocessor for selecting a speed of the motor according to pre-programmed instructions. These pre-programmed instructions preferably comprise instructions to operate the motor in a special operations mode, such as that discussed above.

Most preferably the microprocessor would be programmed so that any errors deliberately introduced were also deliberately corrected say on every minute or five minutes.

The present invention also allows the sound produced by a clock to be controlled. If the pallet mechanism and the escapement were perfectly geared together the clock would operate with little or no traditional "tick tock" sound. This sound is created in known clocks by the escapement wheel being released by one pallet, then accelerating and moving forward until it is caught and brought up short by the second pallet to create a "tick" and then being released by the second pallet and caught again by the first pallet to create a "tack". The different tick tock sound is created by slight differences in clearance and differences in the angle of contact between the pallet face and the escapewheel tooth, as well as slight differences in the speed that the driving force accelerates the escape wheel before it is caught again by a pallet. For a conventional mechanical clock to keep good time the time interval between each tick or tock should be equal so that the clock is said to be "in beat". If the time interval is unequal it is usually because the linkage between the pendulum or balance wheel is not set up symmetrically.

Viewed from a further aspect, the present invention provides a clock having a pallet controlled escapement wheel comprising means by which the sound caused by the escapement wheel tooth contacting the pallet face can be changed whilst the clock is running.

Preferably this is achieved by altering the clearance between the escapement wheel tooth and the pallet face so that the escapement wheel has a slightly longer distance to travel before being caught again by the receiving pallet.

In the preferred clock discussed above, a pallet carrier undergoes an oscillating motion, and this oscillating motion at least partially determines the manner in which the pallets of the clock engage the teeth of the escapement wheel. It has been recognised that by altering the clearance between the escapewheel tooth and receiving pallet catching the escapewheel, the amount of noise generated by the contacting of the teeth of the escapement by the pallets can be increased or decreased.

According to another aspect of the present invention therefore there is provided a clock comprising an escapement, a pallet carrier and a pair of pallets, the pallet carrier, in use, performing an oscillating movement, wherein the clearance between the pallet and the escapewheel tooth is adjustable whilst the clock is running.

When the pallet carrier performs normal timekeeping, contact between the pallets and the escapements is preferably adjusted to the minimum to give a smooth operation of the clock, so that only a minimum amount of noise is generated. When clearance between the pallet carrier and the receiving escapewheel tooth is increased the contact between the pallets and the escapewheel tooth is less smooth and can be somewhat abrupt. This leads to an increase in the noise generated when the pallet contacts the tooth of the escapement. This increase in noise can be used to illustrate the passage of time in an audible manner.

In the preferred embodiment of clock, the pallet carrier is driven by a motor. This permits sustained operation of the preferred clock irrespective of, for example, any increased loss in energy that may occur when the pallets contact the escapement with an increased clearance.

It is preferred that a length of a linkage between the motor and the pallet carrier can be adjusted to provide variable clearance between the receiving pallet and the escapewheel tooth. It is further preferred that the length can be adjusted using a remote control. Through this remote adjustment feature, the clock can be switched from a quiet operation to a louder operation between alternate pallet operations.

Whilst it is possible to link the movement of a pendulum of the clock mechanically to the movement of the escapement, for example, by driving the pendulum from the same motor as the escapement, in a preferred embodiment, the pendulum is driven by a separate motor. This has the advantage of reducing inertia in the system due to the pendulum and also allows for more versatile control of the pendulum movement. From a further aspect, therefore, the present invention provides a clock having an escapement mechanism driven by a first motor and a pendulum driven by a second motor.

Preferably the clock comprises a control, for example a microprocessor control, which coordinates the movement of the pendulum in a desired manner with respect to the escapement. For example, the pendulum may be driven in phase with the escapement mechanism, in opposition to or lagging behind it. The amplitude of the pendulum swing may be varied over a number of swings, or its speed within a swing varied. The movement of the pendulum may be symmetrical or asymmetrical and may be central or off centre.

In a preferred embodiment, the pendulum is driven by a reciprocating carriage which is suitably driven by the drive motor, for example through a drive belt. Preferably the pendulum is pivotally connected to the carriage through a link arm pivotally mounted to the pendulum arm and the carriage.

The motion of the clock and pendulum are controlled electronically in preferred embodiments of the invention which allows the motion of the clock and/or pendulum to be controlled interactively by an observer. For example, the escapement or pendulum mechanisms may be programmed to perform in a certain way upon receiving a suitable signal from the observer. This in itself is a novel arrangement, so from a further aspect, therefore, the present invention provides a clock whose motion is controllable interactively by an observer.

Preferably the control system of the clock is configured such as to revert to normal time keeping operation at predetermined intervals so that the primary function of the clock, i.e. accurate time keeping, is maintained. Thus, for example, the clock could be arranged to revert to normal operation every minute, 5 minutes or quarter hour for example.

Suitable sensors may be incorporated in or associated with the clock in order to provide the interactivity. For example, tactile sensors could be provided which, once touched, initiate interactivity. Different modes of operation of the clock could be initiated by the sensors being operated in a predetermined sequence, for example.

Other sensors could also be provided, for example, visual sensors such as small cameras which can recognise movement of the observer to trigger certain modes of operation of the clock. Similarly an audio sensor such as a microphone could be linked to the control system provide the necessary interactivity.

As mentioned above, John Harrison invented the so-called grasshopper escapement. This was a precision clock escapement that did not require lubrication. Because of its action and superficial resemblance to an insect, it was called a "grasshopper escapement". The inventive feature in Harrison's escapement was that there were no sliding surfaces between the pallet faces and the escapewheel teeth. The period of the swing of the pendulum controlled the rate of the clock and the torque from the driving weights through the escapewheel gave an impulse to the pendulum on each beat. The escapewheel in Harrison's domestic precision regulators is one of the smallest gear wheels in the clock train, about 35 mm in diameter and is hidden away unseen inside the movement and inside the clock case.

At the time of its invention, Harrison's grasshopper escapement in his precision regulator clocks domestic made them the most accurate timekeepers anywhere in the World. Further objects of the present invention are to demonstrate the simplicity of the action of the Harrison grasshopper escapement, to make it visible in operation to an observer and to improve on its function.

According to a further aspect of the present invention there is provided a clock having an escapement mechanism wherein the escapewheel is arranged radially outside the clock face and extends around at least the majority of the periphery of the clock.

Thus the escapewheel, and preferably also the pallet carrier and the pallets, are preferably arranged on the outside of the clock. A clock having these elements arranged on the outside can be more easily observed and the function and operation more easily understood.

According to another aspect of the present invention therefore there is provided a clock comprising an escapewheel, a pallet carrier and a pair of pallets, wherein the escapewheel, the pallet carrier and the pallets are arranged on the outside of the clock.

One preferred clock comprises the escapewheel as the largest wheel in the clock and preferably extending around the outer periphery of the clock with the pallet carrier and pallets arranged above the escapewheel. A virtual pendulum bob may be arranged to swing just below the escapewheel.

Historically, several mechanisms are known in clocks with a single driving mechanism to allow that single mechanism to drive both the timekeeping going train and a strike train. For example, in a spring clock the going train may be driven from the inside of a helically coiled clock spring while the strike train is driven from the outside of the clock spring. In this way the clock keeps running forward whilst the strike train is set off to count out the hour.

Fun clocks are also known that are deliberately made to run backwards for use in bars etc but the present invention is the first clock that may be controlled at will to normally run forwards but also to be run backwards. Through the use of the variation of the motor speed the time lost by running backwards may be made up by increasing the average speed in running forwards. This enables a novel striking method to be incorporated.

As a further preferred feature of the present invention is that a clock may be provided with two distinct backward motions, a first in which the backward motion engages a strike train to strike as required and a second motion in which the clock solely runs backwards.

From a further broad aspect, the invention provides a clock having a striking mechanism which is operative only when the clock is being run backwards.

Preferably the strike train is engaged to be operated in the first backward motion condition by a cam mechanism that engages the strike train mechanically when the minute ring indicates 59 minutes and the seconds ring is moving to indicate 59 seconds. At this 30 point the microprocessor stops the motor just before the pendulum has completed its full swing and the pallets have not started to change over, and then runs the clock backwards. With the strike train now engaged the clock strikes for each backward motion of the escapewheel.

Away from the $59^{th}$ minute and the 5gth second the clock runs backwards without striking.

BRIEF DESCRIPTION OF THE DRAWINGS

A preferred embodiment of the present invention will now be described by way of example only and with reference to the accompanying drawings, in which:

FIG. 5-1 shows a detail of the top right quarter of FIG. 5; (view needs rotating clockwise 90')

FIG. 9-1 shows the mechanism for operating the pallets in a first position;

FIG. 9-2 shows the mechanism for operating the pallets in a second position;

FIG. 10-1 shows a mechanism that permits snapping shut of the grasshopper's lower jaw;

FIG. 10-2 shows a mechanism that permits the tail of the grasshopper performing a stinging action;

DETAILED DESCRIPTION OF THE PREFERRED EMBODIMENTS

Figure 1:
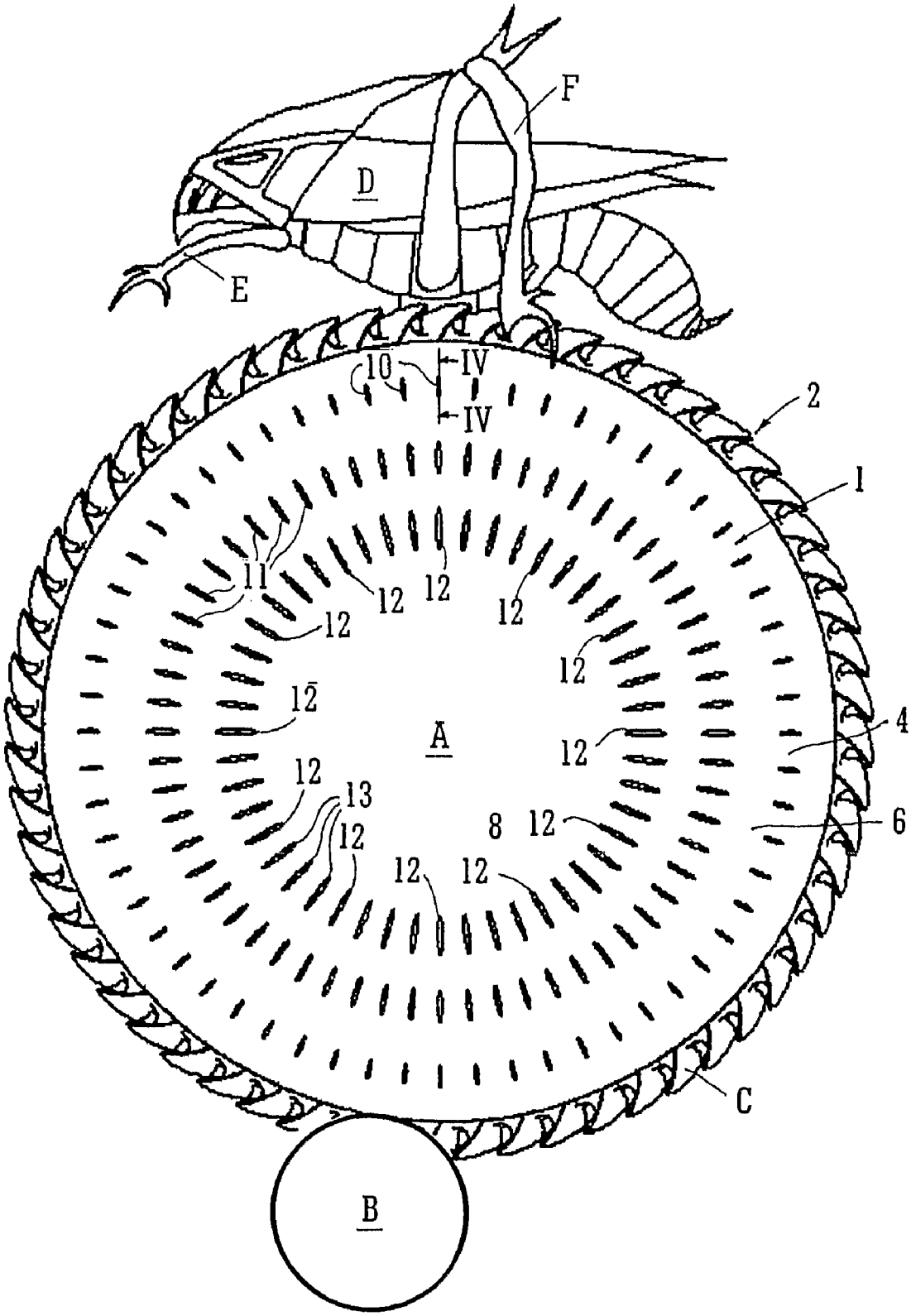
FIG. 1 shows a front view of a clock embodying the present invention.

FIG. 1 shows a front view of a clock embodying the present invention. The main visible components of this clock are the front face A, the virtual pendulum B, the escapewheel C, the pallet carrier D covered by a casing representing the shape of a mythical grasshopper, with the front and hind leg casings covering the front and rear pallets E and F.

Figure 2:
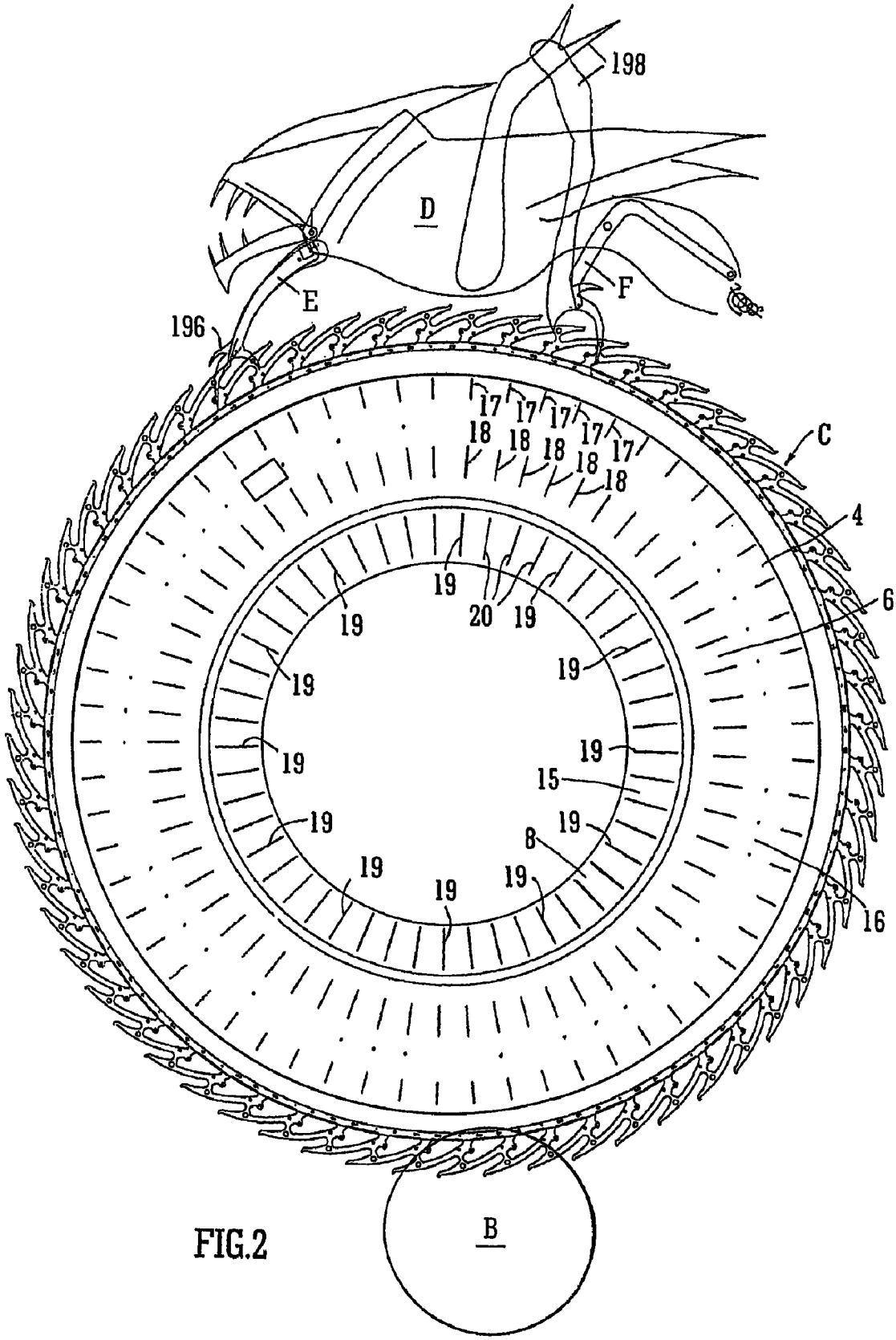
FIG. 2 shows the clock of FIG. 1 with the front face and escapewheel teeth covers removed to show the fixed aperture plates and slits.
Figure 6:
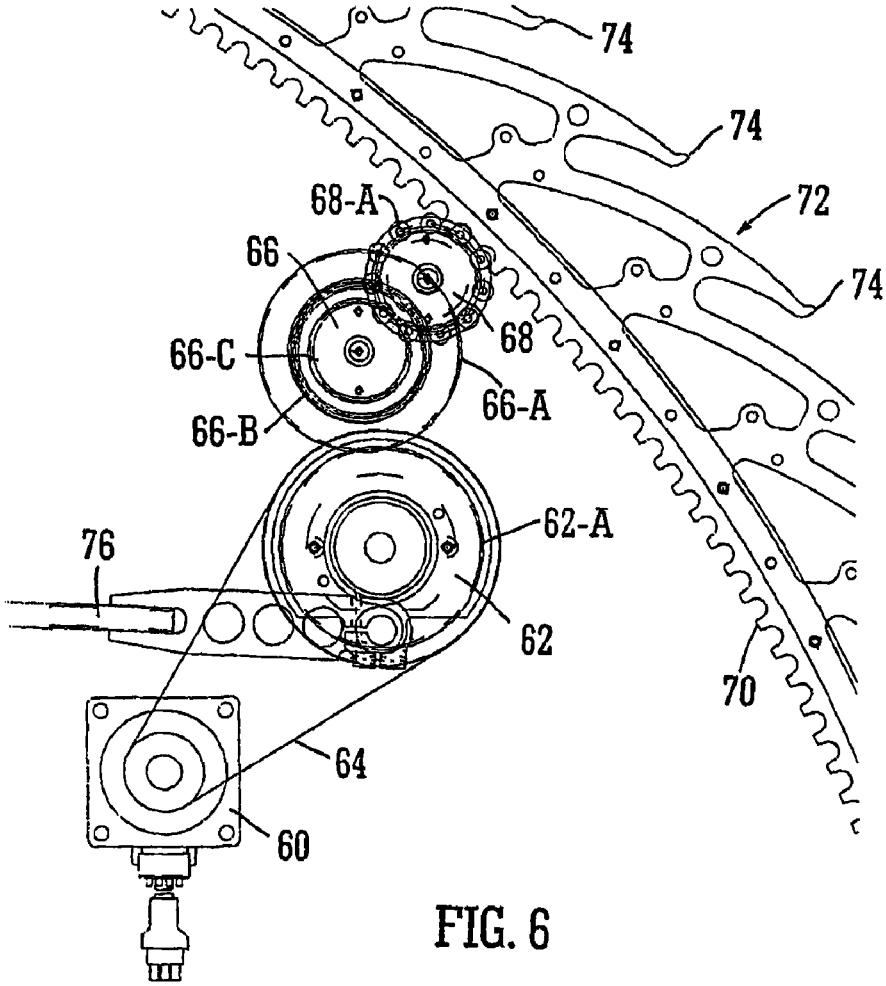
FIG. 6 shows a view of the mechanism driving the 'seconds' shutter ring shown in FIG. 3.
Figure 5:
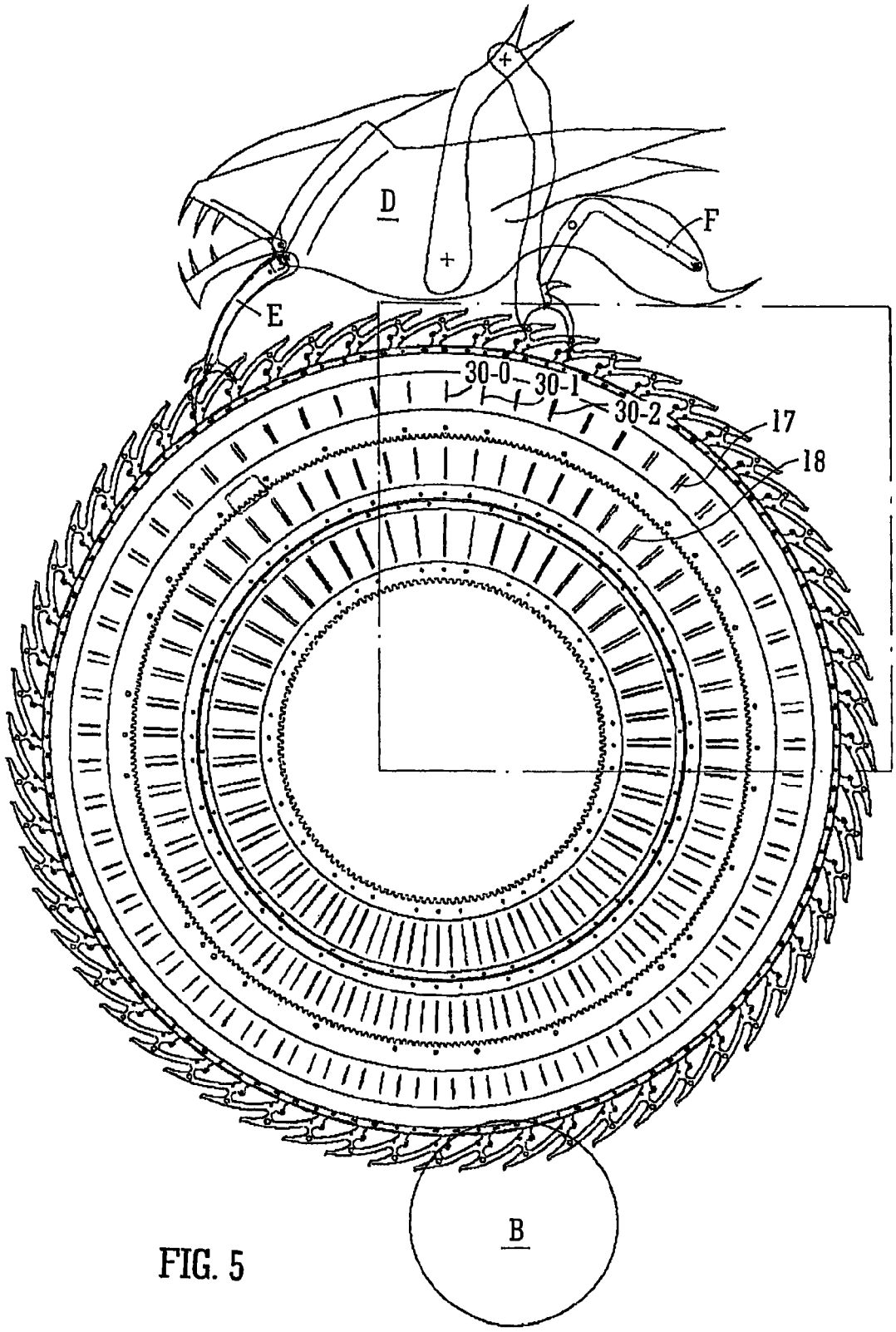
FIG. 5 shows a view corresponding to FIGS. 2 and 3, but with hidden features shown.
Figures 1, 5:
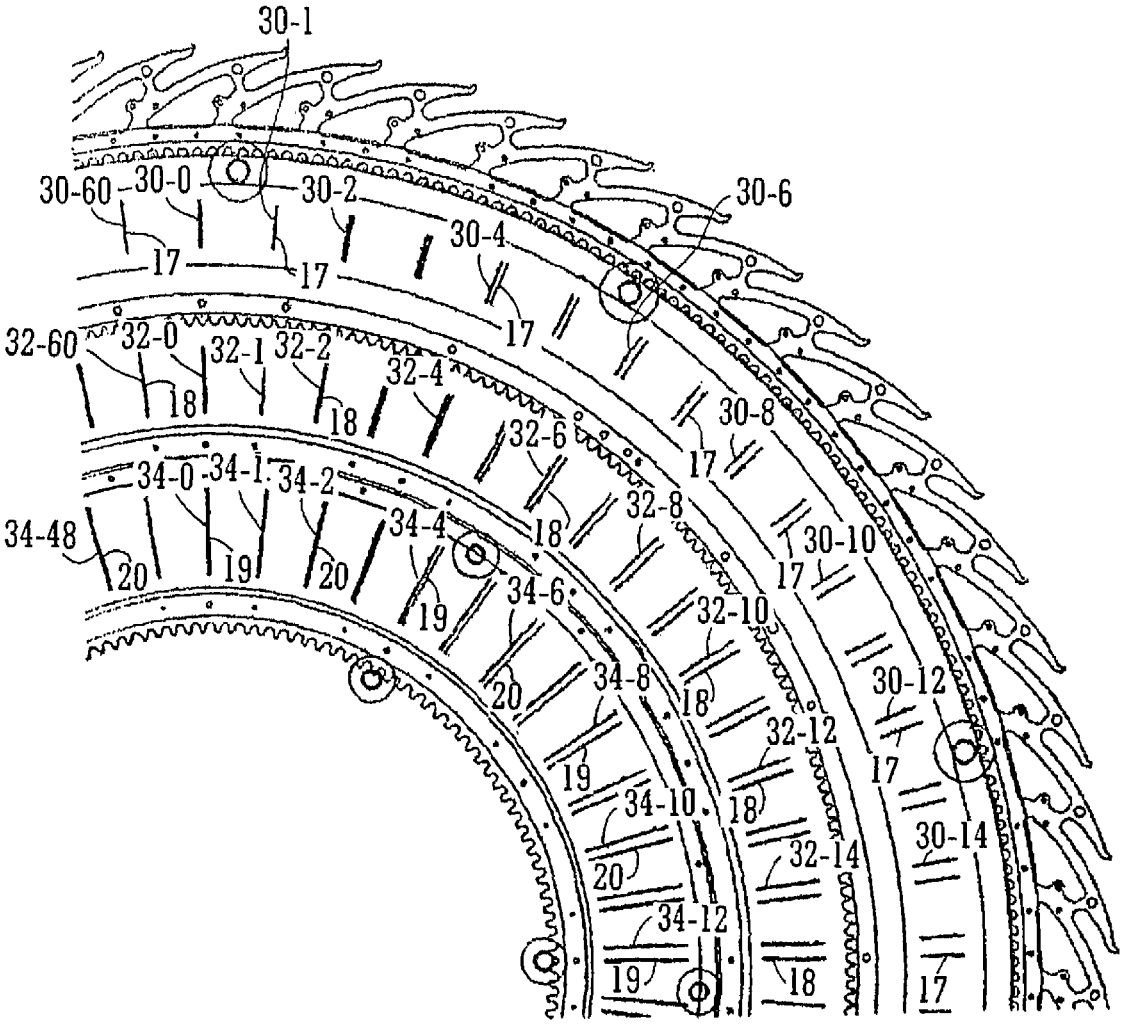

The preferred clock comprises a number of sub-systems that interact with each other. These sub-systems are:

- a sub-system comprising the front face A of the clock with three rings of radially extending slots and three shutter rings arranged behind this front face A (as shown in FIGS. 1 and 2) the shutter rings comprising radially extending slits;
- a sub-system for the rotating shutter rings (as shown in FIGS. 5 and 6); a sub-system for moving the virtual pendulum B and the pallet-carrier D (shown in FIG. 7);
- a sub-system for moving and guiding the front and rear pallets E and F (shown in FIG. 8) and
- a sub-system for moving the jaw and tail of a mythical grasshopper defined by the pallet carrier 30 D and the front and rear pallets E and F.

The architecture of these sub-systems will now be described in detail with the sub-systems being presented in isolation from each other. Subsequently the interaction of the sub-systems and the complete working of the clock will be described in detail.

The Clock's Front Face and Shutter Mechanism

FIG. 1 shows a front view of a preferred clock 2. The front face 1 of clock 2 has an undulating surface of concentric wave-like crests and troughs. As can be seen from FIG. 1, the front face of clock 2 further comprises three concentric rings 4, 6 and 8 of radially extending slots 10, 11, 12 and 13.

The outer ring of slots 4 comprises sixty equidistantly spaced radially extending lenticular slots 10 for indicating seconds. The ring of slots 6 is arranged to indicate minutes and also comprises sixty equidistantly spaced radially extending lenticular slots 11. The central ring of slots 8 comprises twelve equidistantly spaced radially extending lenticular slots 12 for indicating hours. Between each adjacent pair of these twelve slots 12 three further, shorter equidistantly spaced radially extending lenticular slots 13 are provided for indicating quarter hours.

Each of the slots 10, 11, 12 and 13 holds a lens 14, the purpose and geometry of which will be described 20 in more detail below.

FIG. 2 shows a front view of the preferred clock 2 of FIG. 1 with the undulating front face 1 and lenses removed. Radially extending inner and outer static aperture plates 15 and 16 lie behind the front face 1 as can be seen from FIG. 2, 15 with a single ring of apertures for hours and quarter hours, 16 with two rings of apertures for seconds and minutes. The three concentric rings of apertures 17, 18 and 19/20, are aligned with the slots 10, 11 and 12/13 in the front face 1 of the clock. The narrow apertures 17, 18 and 19/20 otherwise correspond generally in size and number with the lenticular slots 10, 11 and 12/13. The static aperture plates 15 and 16 are fixed to the chassis of the clock and so the apertures are fixed in position relative to the slots in front plate. As will be described further below, the apertures from part of a Vernier type shutter system.

Figure 3:
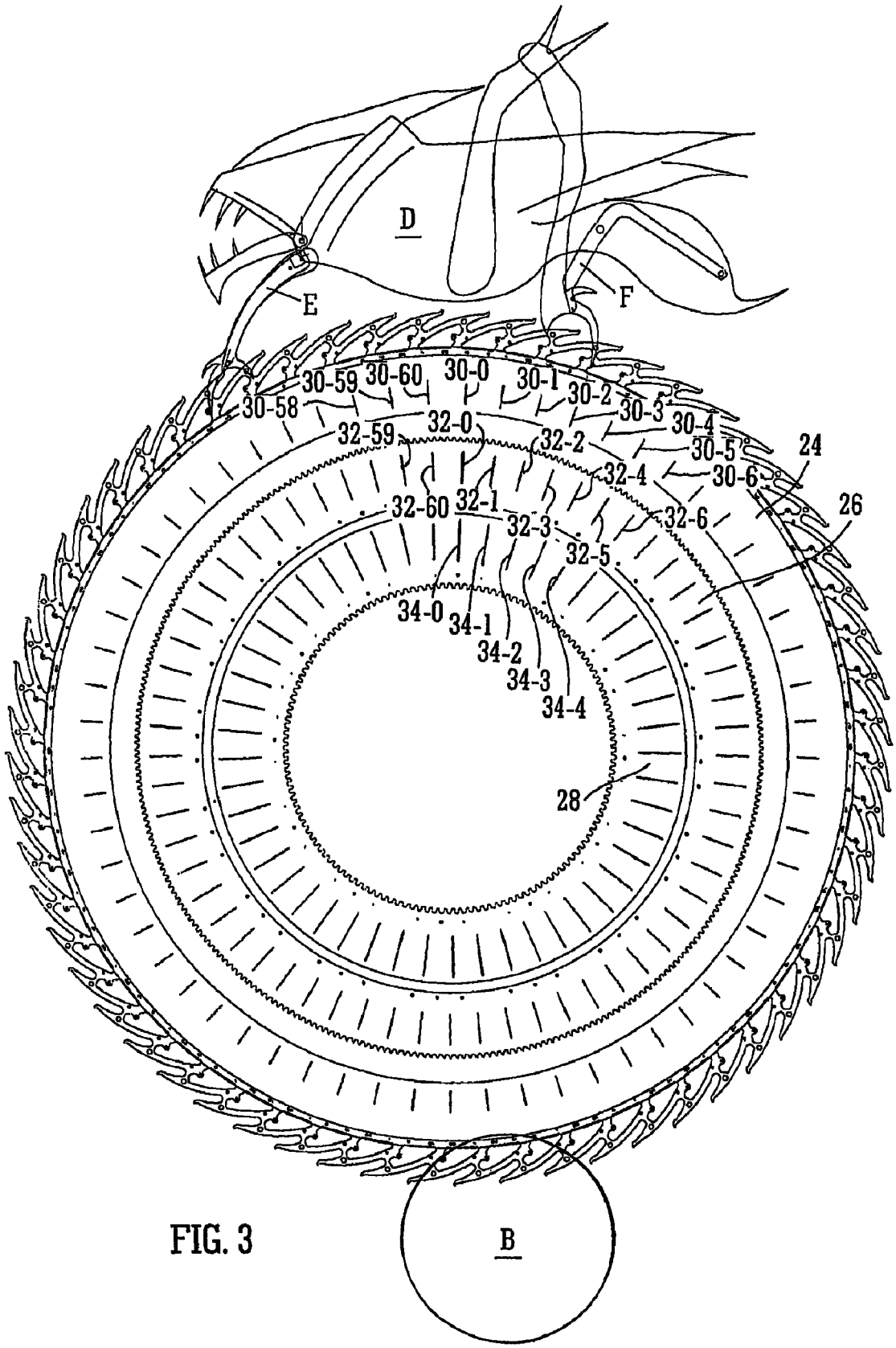
FIG. 3 shows a view of the clock of FIG. 1 with the planar plates of fixed slits removed to show the rotating shutter plates and slits.

Arranged behind the static aperture plates 15 and 16 are three concentric, rotatable shutter rings, namely 'seconds' shutter ring 24, 'minutes' shutter ring 26 and 'hours' shutter ring 28, as shown in FIG. 3. Rings 24 and 26 each comprise sixty-one equidistantly spaced radially extending slits 30-0 to 30-60 and 32-0 to 32-60 respectively. Ring 28 comprises forty-nine equidistantly spaced radially extending slits 34.34-48.

Slits 30-0 to 30-60 and 32-0 to 32-60 in the two outer rings 24 and 26 have substantially the same length and width as apertures 17 and 18 in the static aperture plate 16 which also are aligned with lenticular slots 10 and 12 in the front face of the clock. The length and width of the slits 34-0 to 34-48 provided in the inner ring 28 are substantially the same as the apertures 19 and 20 provided in static aperture plate 15 and align and corresponds to the length of the twelve hour slots 16 in the front face of the clock.

The respective slits 30, 32 and 34 in the rotatable shutter rings are also formed on the same pitch circle diameters as the apertures 17, 18 and 19/20 in the static aperture plates 15 and 16 and as the slots 10, 11 and 12/13 in the front face 1 of the clock. Light passing through one of slits 30-0 to 30-60, 32-0 to 32-60 or 34-0 to 34-48 in the rotating shutter can pass through an aperture 17, 18 or 19/20 in the static aperture plates and a slot 10, 11 or 12/13 in the front face of the clock in an un-attenuated manner when pairs of apertures and slots are in rotational alignment.

Figure 4:
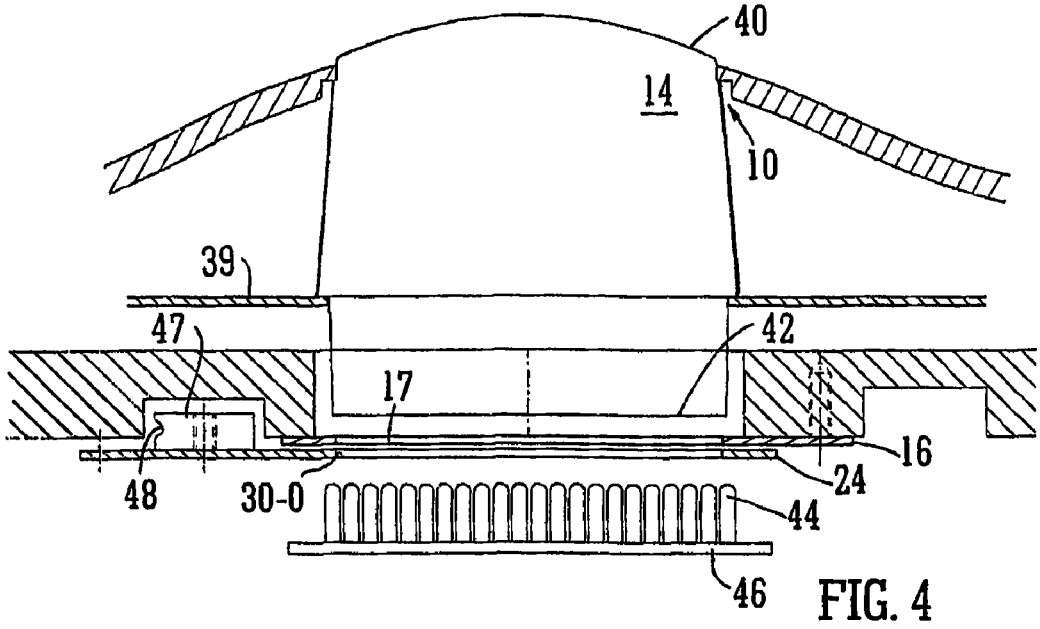
FIG. 4 shows a cross-section along line 4-4 shown in FIG. 1.

FIG. 4 shows a cross-section of clock 2 along line 4-4 shown in FIG. 1. In FIG. 4 slots 10 and aperture 17 are mounted in alignment with each other and slit 30-0 is rotationally aligned with both. Lens 14 has a planar light entry surface 42 that is arranged parallel and slightly spaced apart from the surfaces of static aperture plate 16. Lens 14 acts as a light guide by receiving light from a narrow aperture in the static aperture plate and conducting the majority of the light by total internal reflections to be emitted from the wider elliptical plan form in the front face of the clock. The lens 14 is held in slot 10 by carrier plate 39 and has a surface 40 that lies slightly proud of the front face 1 of the clock 2 and has a curved and matt or frosted front surface to enable the light to be observed over a wide angle as well as normal to the face of the clock.

Also shown in FIG. 4 are light sources 44 arranged in a plane parallel to 'seconds' shutter ring 24 and on the same pitch circle diameter. In the preferred embodiment shown in FIG. 1 to 4, light sources 44 are lines of LEDs mounted on printed circuit board (PCB) 46. In the preferred embodiment the light entry surface 42 of lens 14 is frosted, so that light from the line of multiple LEDs is diffused upon entry into lens 14, so that an observer cannot distinguish between the separate light sources 44 after the multiple internal reflections as the light is guided up the lens to the front face.

Light sources 44 on PCB 46 are mounted to the chassis of the clock 2 in alignment with the median line of the fixed apertures directly above as well as the median line of lens 14 and slot 10. As mentioned above, shutter rings 24, 26 and 28 are rotatable and it will accordingly be understood that rings 24, 26 and 28 will attenuate light emitted by light sources 44 unless a slit 30-0 is in alignment with a corresponding aperture 10 and with light sources 44. When a slit 30 is rotated into alignment with an aperture 17 which is fixed in 35 alignment with a corresponding slot 10, light from light sources 44 enters the lens 14 through light entry surface 42, is scattered by the frosting and propagates through lens 14 both directly and by multiple internal reflections to exit lens 14 through top surface 40. Lens 14 therefore acts as light pipe for channeling 5 light from aperture 17 to light exit surface 40.

Each one of the slots 10, 11, 12 and 13 and their lenses has associated light sources 44 as shown in FIG. 4.

Also shown in FIG. 4 is a guide ring 47 mounted to 'seconds' shutter ring 24. The ring 47 comprises a U-shaped groove 48 for engaging with rollers that are arranged around the circumference of the ring 47 and that guide the rotating motion of 'seconds' shutter ring 24. 'Minutes' and 'hours' shutter rings 26 and 28 are provided with guide rings similar to guide ring 47 provided on the 'seconds' shutter ring 24. The actual shutter rings 26 and 28 with their multiple slits are comparatively flimsy and flexible, so the guide rings 47 maintain the shutter rings 26 and 28 in better spatial alignment and clearance with respect to the fixed aperture plates.

The circumferential width of the apertures in the fixed 'seconds' and 'minutes' aperture plate 16 is preferably less than one three thousand six hundredth part of the minimum circumference at the base of the slits. For ease of manufacture the apertures are made with parallel sides, rather than tapering with radius. This ensures that there are 59 slit width positions between each pair of adjacent slits. The slits in the shutter rings should preferably have a width the same as or smaller than the aperture width.

FIGS. 5 and 5-1 illustrate the relative radial positions of 'seconds' apertures 17-0 to 17-59 and slits 30-0 to 30-60, 'minute' apertures 18-0 to 18-59 35 and slits 32-0 to 32-60 and 'hour' and 'quarter hour' apertures 19-0 to 19-11 together with the intermediate 20 apertures and slits 34-0 to 34-48 for the case where the clock 2 indicates 12 o'clock midday or midnight. In this case, the slots 10, 11 and 12 that extend vertically on the upper half of the front face of clock 2 will be in fixed alignment with apertures 17-0, 18-0, and 19-0 in static aperture plates 16 and 15 and also exactly in alignment with slits 30-0, 32-0 and 34-0 of rotating shutter rings 24, 26 and 28 respectively so that the light emitted from the three linear light sources of LEDs 44 passes through the moving slits in the rotating shutter rings, passes unattenuated through the apertures in the static aperture plates, is gathered by the lenses and displayed on the face of the clock 2 as three vertical bars of light representing the time of exactly 12 o'clock.

Each ring of slots 4 and 6 in the front face 1 of the clock 2 comprises sixty equidistantly spaced slots 10 and 11 which are in alignment with sixty equidistantly spaced apertures 17 and 18 provided in the static aperture plate 16. The rotating 'seconds' and 'minutes' shutter rings 24 and 26 in contrast each comprise sixty-one equidistantly spaced slits. Thus the angular spacing of slits 30-0 to 30-60 is smaller than the angular spacing of apertures 17. Equally, the angular spacing of slits 32-0 to 32-60 is smaller than the angular spacing of apertures 18.

The different number of apertures in the static plate 16 and the slits in shutter rings 24 and 26 together with their chosen width of less than one three 30 thousand six hundredth of the minimum pitch circle circumference form a Vernier arrangement whereby only one slit of the sixty-one slits 30-0 to 30-60 and 32-0 to 32-60 in shutter rings 24 and 26 can at any one time be in perfect alignment with an aperture 17 or an aperture 18.

It will be appreciated at exactly 12 o'clock that only light emitted by light sources 44 located behind these particular three vertically extending and aligned slits and apertures can propagate through in an unattenuated manner and be gathered up by the lenses 14 to be displayed on the front face of the clock. Light emitted by light sources located behind all the other slots and lenses in the face can not enter the corresponding apertures in the static aperture plate 16 as the each and every other slit in the rotating shutter plate is out of line and masks the fixed apertures from the light sources. An observer will accordingly only see the vertically extending slots 10, 11, and 12 fully illuminated to display the uniae time of 12 o'clock midnight or midday in the example of FIGS. 5 and 5-1. It can be seen from FIG. 5-1 that the difference in spacing between fixed apertures 17 and the moving slits 30 increases with increasing distance from slot 30-0. It is important to note that all of slits 30-1 to 30-60 are located on the counter clockwise side of a corresponding slot 10. This means that, when 'seconds' shutter disc 24 is rotated, by one three thousand six hundredth part of the pitch circle circumference a slit 30-1 comes into alignment with the next clockwise adjacent fixed apertures 17-1. Starting from 12 o'clock, when 'seconds' shutter ring 24 is rotated, as the misalignment between slit 30-1 and the adjacent aperture 17-1 for slot 10-1 is the smallest, slit 30-1 is the first rotating slit to come into perfect rotational alignment with fixed aperture 17-1 and slot 10-1. The next slit that comes into rotational alignment with a fixed aperture and associated lens and slot in the clock face is slit 30-2 as the rotational misalignment with the adjacent aperture 17-2 for slot 10-2 is the second smallest. Slit 30-60 is maximally misaligned with aperture 17-59 and appears to be very close to alignment with the counter-clockwise adjacent aperture 17-59. It will be appreciated that, as 'seconds' shutter ring 24 is rotated in the clockwise direction, slit 30-60 moves away from this counter-clockwise adjacent slit 17 and towards the clockwise adjacent aperture 17-0 and is accordingly the last one of slits 30-1 to 30-60 to come into alignment with an aperture 17 when 'seconds' shutter ring 24 is rotated.

Mechanism for Rotating the 'Seconds' Shutter Ring

In the following description the mechanism for rotating the 'seconds' shutter ring 24 will be described.

FIG. 6 shows an enlarged view of part of the rectangular section labelled VI in FIG. 5 but with shutter rings 24, 26 and 28 removed to show a detailed view of the mechanism employed to rotate the 'seconds' shutter ring 24. The rotation of the 'seconds' ring is directly controlled by the escapement mechanism which consists of an escapewheel 72 mounted on the outside of the seconds ring 24 and two pallets 150, 152 mounted on a pallet carrier 114 (see FIG. 9).

As the pallets are connected to the virtual pendulum that oscillates, the motion of the 'seconds' ring is intermittent and it would be exceedingly complex to drive this intermittent motion directly from the drive motor. This problem is overcome by including some resilience in the drive mechanism in the form of a spiral drive spring that can take up half a turn of so in either direction without a large change in the driving torque of the escapewheel.

A motor 60, preferably a servo motor, is connected to and continuously drives crank 62 via a precision toothed drive belt 64. Crank 62 comprises a gear ring 62-A which meshes and drives a gear ring 66-A provided on the outside of spring device 66.

Spring device 66 comprises a spiral flat coil of spring steel that can be wound up like a clock spring to provide the required torque to urge the escapewheel 72 on the outer periphery of the 'seconds' ring 24 against the pallet arms 150, 152. The spiral coil provides a low rate, virtually constant, torque even as the coil winds up or unwinds an extra half turn or so. On its outside the spring 66-B is wound through the rotation of gear ring 66-A induced by the crank 62. An inside end of spring 66-B is connected to, and drives, a further gear wheel 66-C. Gear wheel 66-C is driven by the torque in the spring 66-B and meshes with and drives gear wheel 68. The servo motor 60 is accordingly adapted to provide the torque to urge the escapewheel 72 up against the pallet arms 150, 152 as they in turn engage and disengage with the corresponding teeth in the escapewheel 72 through a constant force drive spring 66. The spring also takes up the intermittent stop go motion of the virtual pendulum and the pallet carrier 114 whilst being continuously driven by the drive motor.

FIG. 6 shows three of the sixty teeth 74 of the escapewheel 72, an actuation rod 76 eccentrically mounted on crank 62 and connected to the virtual pendulum B and pallet carrier 114 as will be explained below. Further provided is a precision toothed drive belt (not shown) for accurately positioning the pallet faces to follow precisely the end of the appropriate escapewheel tooth 74 as will be described in more detail below.

Mechanism for Rotating the 'Minute' Shutter Ring

Figure 7:
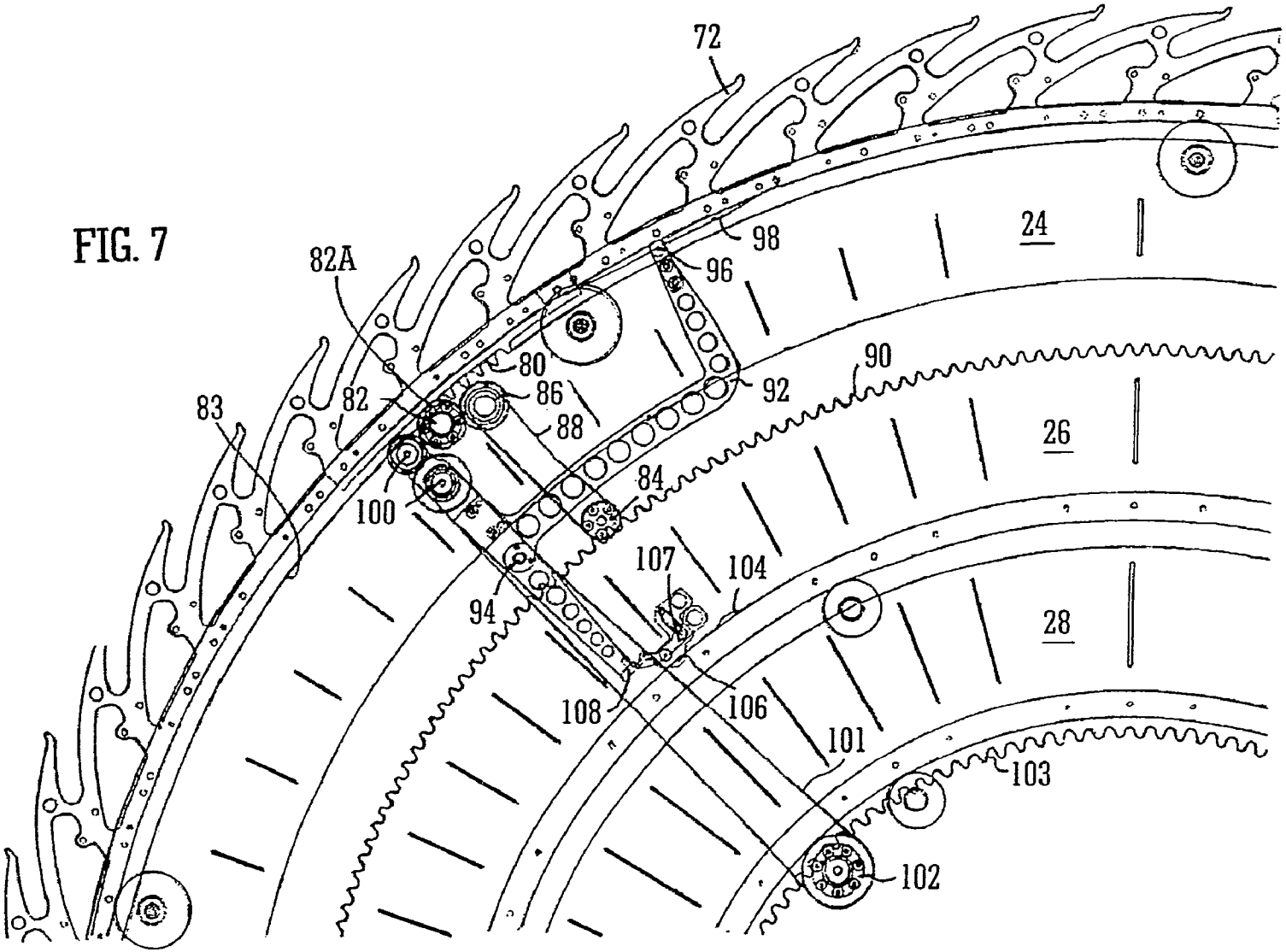
FIG. 7 shows illustrates the mechanisms used for transmitting rotational motion from the 'seconds' shutter ring to the 'minute' and 'hours' shutter rings.

FIG. 7 illustrates a mechanism for transmitting rotational movement from the 'seconds' shutter ring 24 on to the 'minutes' shutter ring 26. As can be seen from FIG. 7, a short section of six teeth 80 is provided on an outer edge of 'seconds' shutter ring 24—on the inside of the escapewheel 72 respectively. Teeth 80 mesh with a birdcage gear 82 created from six small sealed roller cage bearings when teeth 80 are in an appropriate rotational location as the seconds wheel revolves, typically between the $59^{th}$ and $60^{th}$ or zero second positions. Gear 82 drives gear 84 through one revolution via driving cylinder 86 and precision toothed drive belt 88.

'Minutes' shutter ring 26 comprises a continuous row of teeth 90 along an outer edge thereof. Teeth 90 mesh with gear 84 and it will be appreciated that, every time teeth 80 mesh with gear 82, gear 84 rotates so as to rotate 'minutes' shutter ring 26. Teeth 80, 90, gears 82 and 84, drive cylinder 86 and drive belt 88 rotate 'minutes' shutter ring 26 by one sixtieth of a revolution every time teeth 80 move past gear 82. Because of the reduced circumference on the minutes wheel 26 as compared to the larger seconds wheel 24 the pitch of the six teeth 80 correspond to five teeth on 90 and the diameters of birdcage wheels 82 and 84.

Three of the six roller bearings of birdcage pinion 82 have a second roller bearing mounted coaxially therewith above the plane of the teeth 80 (in the sense of FIG. 7) forming an equilateral triangle. A ring 83 is provided in the plane of these rollers with a cut out aligned with the teeth 80. The effect of this is after the shutter ring 24 moves on after engagement of the teeth 80 with the pinion 82, two of the three roller bearings will engage the ring 83, thereby preventing further rotation of the pinion 82, and hence locking pinion 86, the toothed belt 88 and birdcage wheel 89 and finally wheel 90 on the outside of rotating shutter ring 26. Thus the slit 34 opposite the aperture 17 is locked in place for the next 59 seconds until the cut out and 35 teeth 80 release the minute ring and index it forward a further 6° before being locked again, indicating the next minute.

Mechanism for Rotating the 'Hours' Shutter Ring

Further referring to FIG. 7, a lever 92 is arranged to be pivotable about pivot point 94. Lever 92 comprises a cam follower 96. A cam 98 is on the inside of escapewheel 72. In the preferred embodiment cam 98 is provided in a position diametrically opposite to teeth 80, rather than in the position shown in FIG. 7. FIG. 7 merely intends to illustrate that cam follower 96 causes lever 92 pivot about pivot point 94 in a clockwise direction when cam follower 96 travels over cam 98.

Lever 92 further comprises drive mechanism 100 at an end thereof. Drive mechanism 100 comprises a gear wheel that can mesh with and is driven by gear wheel 82 and that drives precision toothed drive belt 101. Drive belt 101 in turn drives gear wheel 102 through gear teeth 103 provided on the 'hours' shutter ring 28.

When cam follower 96 is in contact with the larger diameter inner surface of the escapement that does not form cam 98, drive mechanism 100 does not mesh with gear wheel 82 and no driving force can be transmitted to gear teeth 103 on 'minutes' shutter ring 28 in this configuration.

When cam follower 96 contacts cam 98, drive mechanism 100 meshes with gear wheel 82 for a period of time and in this configuration driving force can be transmitted from gear wheel 82 to gear teeth 103. However, as mentioned above, cam 98 is located in a position diametrically opposite of the teeth 80 and cam 98 is positioned so that gear wheel 82 is not normally driven when driving mechanism 100 meshes with gear wheel 82.

When cam follower 96 contacts cam 98 driving mechanism 100 simply travels into and out of engagement with gear wheel 82 without any driving force being transmitted in a normal operation mode. Accordingly in this normal operation mode, gear teeth 80 can travel past and drive gear wheel 82 without driving force being transmitted to gear teeth 103. It will be appreciated that the driving of gear wheel 82 by gear teeth 80 once every minute does not cause a driving of gear teeth 103 in a normal mode of operation but that gear teeth 90 on the 'minutes' shutter ring 26 are driven once every minute through this driving action.

Four equidistantly spaced cams 104 are further provided on a cylindrical surface of the 'minutes' shutter ring 26. These cams 104 are arranged to be contacted by cam follower 106 provided on a locking mechanism 107. When cam follower 106 is contacted by one of cams 104 the locking mechanism 107 is pushed towards the lower end 108 of lever 92. When cam follower 96 contacts cam 98 while the locking mechanism 107 is in this configuration, locking mechanism 107 locks onto lower end 108 of lever 92 and holds lever 92 in the position in which driving mechanism 100 engages gear wheel 82. Driving mechanism 100 accordingly remains in driving contact with gear wheel 82 when cam follower 96 looses contact with cam 98. When in this configuration gear teeth 80 next drive gear wheel 82, the driving force provided to gear wheel 82 is transmitted to the driving mechanism 100 and onwardly to gear teeth 103 via drive belt 101 and gear wheel 102. In this configuration, 'hours' shutter ring 28 is accordingly rotated.

As 'minutes' shutter ring 26 carries four equidistantly spaced cams 104, around its outer edge it will be appreciated that 'hours' shutter ring 28 is rotated 360/48=7.5 degrees once every quarter hour. Gear wheels 82 and 102, drive mechanism 100, drive belt 101 and gear teeth 103 are arranged so that one passage of gear teeth 80 past gear wheel 82 causes 'hours' shutter ring 28 to be rotated by one forty-eighth of a full rotation, thus moving slot 34-0 from alignment with one slot 19/20 into alignment with the clockwise adjacent slot 19/20.

Mechanism for Operating the Virtual Pendulum and the Pallet Carrier

Figure 8:
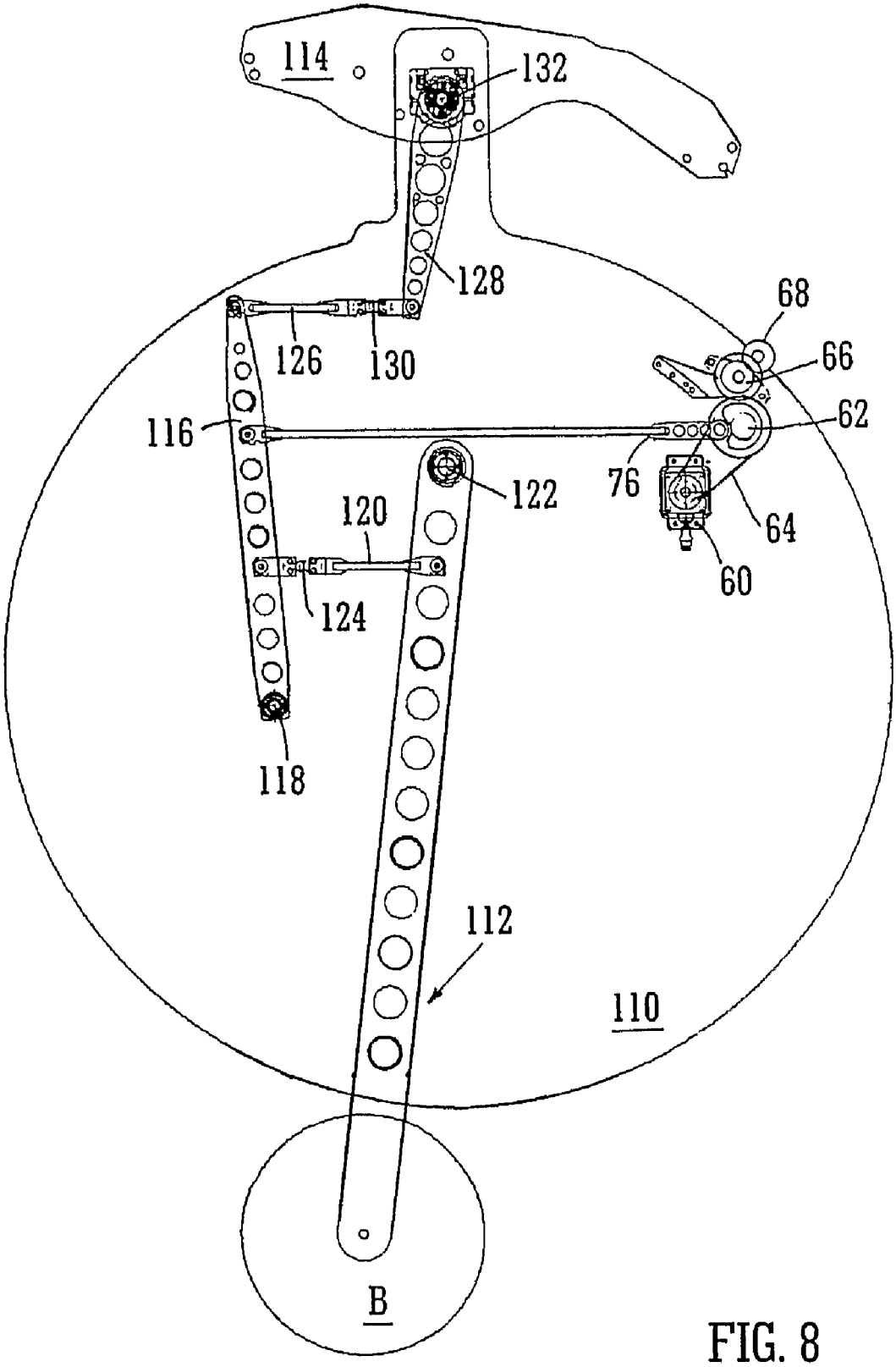
FIG. 8 shows a view of the base plate of the clock with all components other than the mechanism for operating the pendulum and the pallet carrier removed.

FIG. 8 shows base plate or chassis 110 of clock 2 with all components that do not form part of the mechanism actuating the virtual pendulum 112 and the pallet carrier 114 removed. It will be appreciated that, as clock 2 is solely driven by motor 60, the virtual pendulum 112 does not fulfil the time keeping function normally associated with a pendulum in a known clock but serves merely to give a visual representation of an actual pendulum. Accurate time keeping of the preferred clock 2 solely depends on the driving speed of motor 60 (as will be explained in more detail below) and pendulum 112 is accordingly provided for cosmetic purposes only.

As discussed above in relation to FIG. 6 rod 76 is eccentrically mounted on crank 62, so that, when crank 62 is rotated by motor 60, rod 76 reciprocates continuously left and right. Rod 76 is connected to arm 116 pivotally mounted at its lower end to base plate 110 at pivot point 118. A further rod 120 connects arm 116 to pendulum 112. Pendulum 112 is pivotally mounted to base plate 110 at point 122. Rod 120 comprises an extendible section 124 for adjusting the length of rod 120. This adjustment is used to endure that in spite of any manufacturing tolerances the swing of the virtual pendulum is symmetrical about the centreline.

Rod 126 connects arm 116 to a further arm 128. Rod 126 also comprises an extendible section 130 for adjusting the length of rod 126 to ensure that in spite of any manufacturing tolerances the movement of the pallet carrier is symmetrical about the centreline.

The upper end of arm 128 is fixedly attached to a pallet carrier 114 at point 132. The combination of pallet carrier 114 and rod 128 is pivotally mounted to base plate 110 at the point 132. The interconnection of links and pivots ensures that the movement of the virtual pendulum and the pallet carrier are always in phase.

Mechanism for Operating the Front and Rear Pallets

Figures 1, 9:
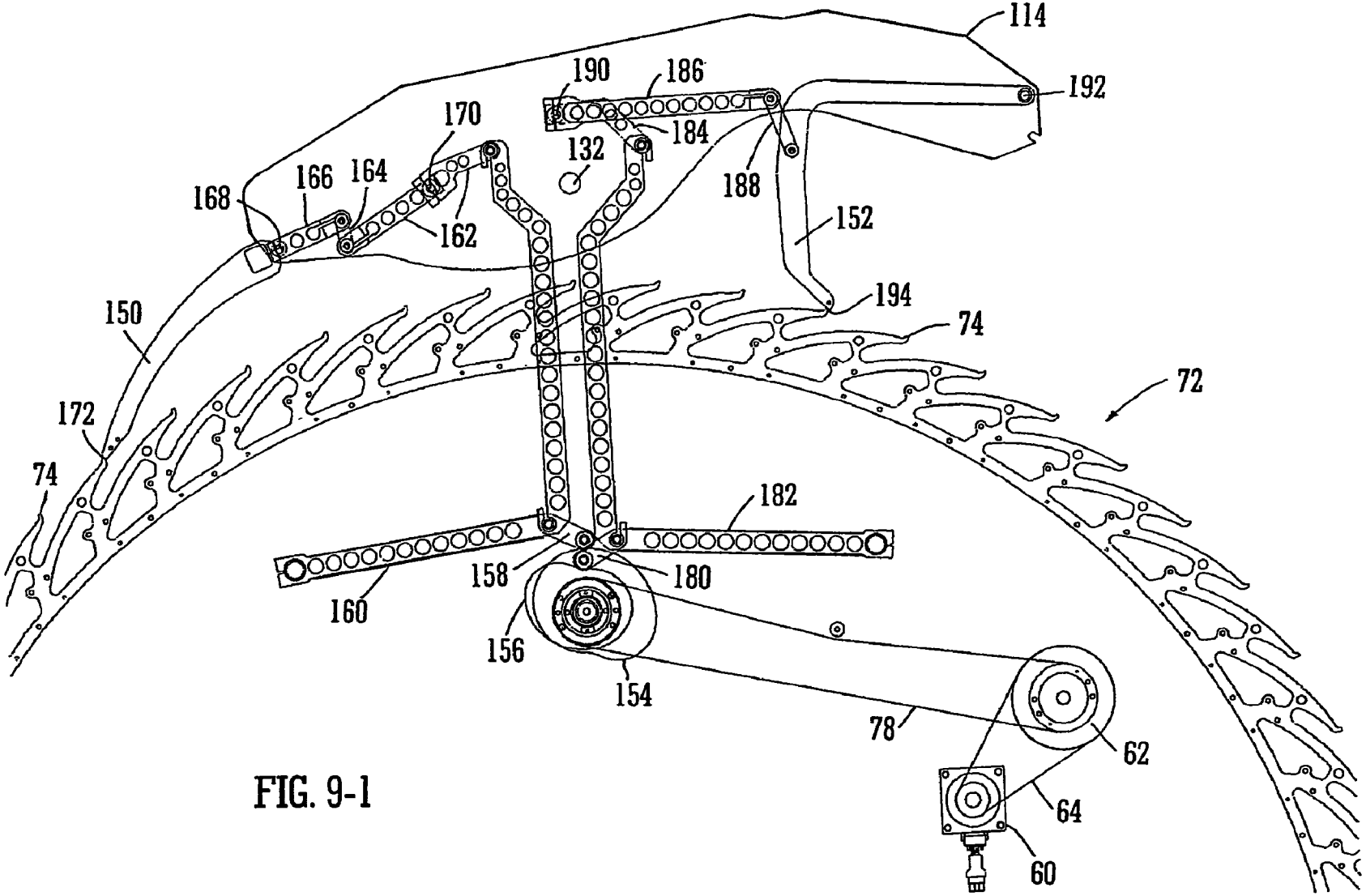
Figures 2, 9:
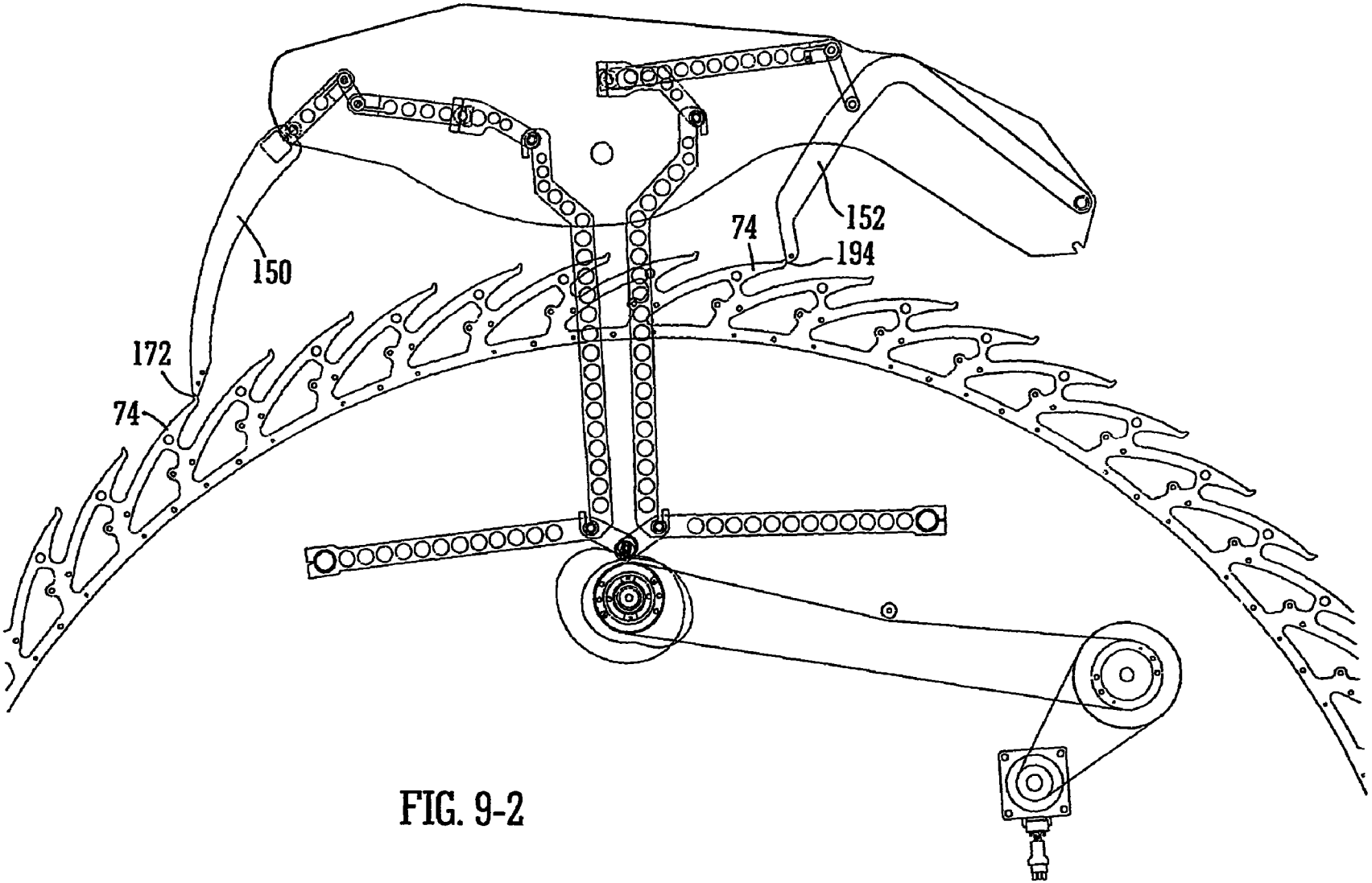

FIG. 9-1 shows the mechanism for operating a front pallet 150 and a rear pallet 152 which are mounted to the pallet carrier 114. As previously stated in relation to FIG. 6, a cylindrical precision toothed drive belt contact surface on crank 62 drives a precision toothed drive belt, which is indicated by reference numeral 78 in FIG. 9. Drive belt 78 in turn drives two cams 154 and 156 which can rotate relative to base plate 110 and are fixedly attached to each other, one behind the other, so as to prevent relative movement between them and the drive mechanism. Cams 154 and 156 perform one full rotation every two seconds.

Cam follower 158 is connected to front pallet 150 via L-shaped bracket 160 and rods 162, 164 and 166. The connections between L-shaped bracket 160 and rod 162, the connection between rod 162 and rod 164 and the connection between rod 164 and rod 166 allow relative rotational movement between L-shaped bracket 160 and rod 162, between rods 162 and 164 and between rods 164 and 166. Rod 166 is fixedly attached to front pallet 150 so as to prevent relative movement. The combination of front pallet 150 and rod 166 is pivotally attached to pallet carrier 114 at pivot point 168. Rod 162 is pivotally attached to pallet carrier 114 at pivot point 170. Front pallet 150 has a contact surface 172 for contacting the tip of teeth 74 of escapewheel 72.

Cam follower 180 is connected to rear pallet 152 via L-shaped bracket 182 and rods 184, 186 and 188. Pallet 152 is deliberately made L shaped to hide behind the cosmetic rear leg 198. The connections between L-shaped bracket 182 and rod 184, the connection between rod 186 and rod 188 and the connection between rod 188 and rear pallet 152 allow rotational movement between L-shaped bracket 182 and rod 184, between rods 186 and 188 and between rod 188 and rear pallet 152. Rod 184 is fixedly attached to rod 186 to prevent relative movement between rods 184 and 186. The combination of rods 184 and 186 is pivotally attached to pallet carrier 114 at pivot point 190. Rear pallet 152 is pivotally attached to pallet carrier 114 at pivot point 192. Rear pallet 152 has a contact surface 194 for contacting the tips of the teeth 74 of escapewheel 72.

As already mentioned above, the assembly of pallet carrier 114 and pallets 150 and 152 is in the preferred embodiment presented in the form of a mythical grasshopper. Consistent with this, front pallet 150 is covered with a covering member 196 (FIG. 2) that has the appearance of the front leg of a grasshopper, while rear pallet 152 is covered with covering members 198 (FIG. 2) that have the appearance of a hind leg of a grasshopper. Covering member 198 is pivotally mounted to the pallet carrier 114 in pivot point 132.

Mechanism for Moving Jaw and Tail of the Grasshopper

Figures 1, 10:
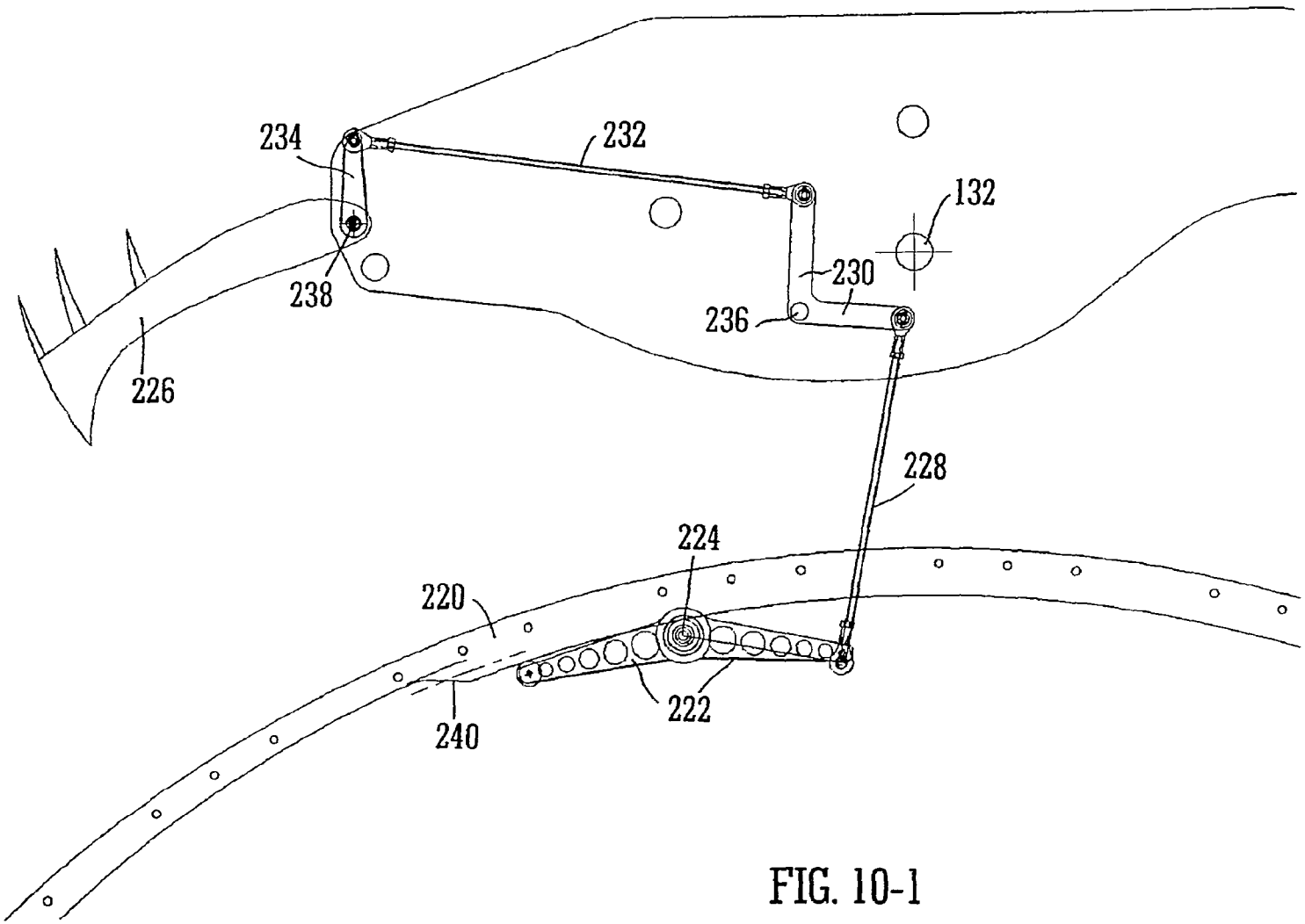
Figures 2, 10:
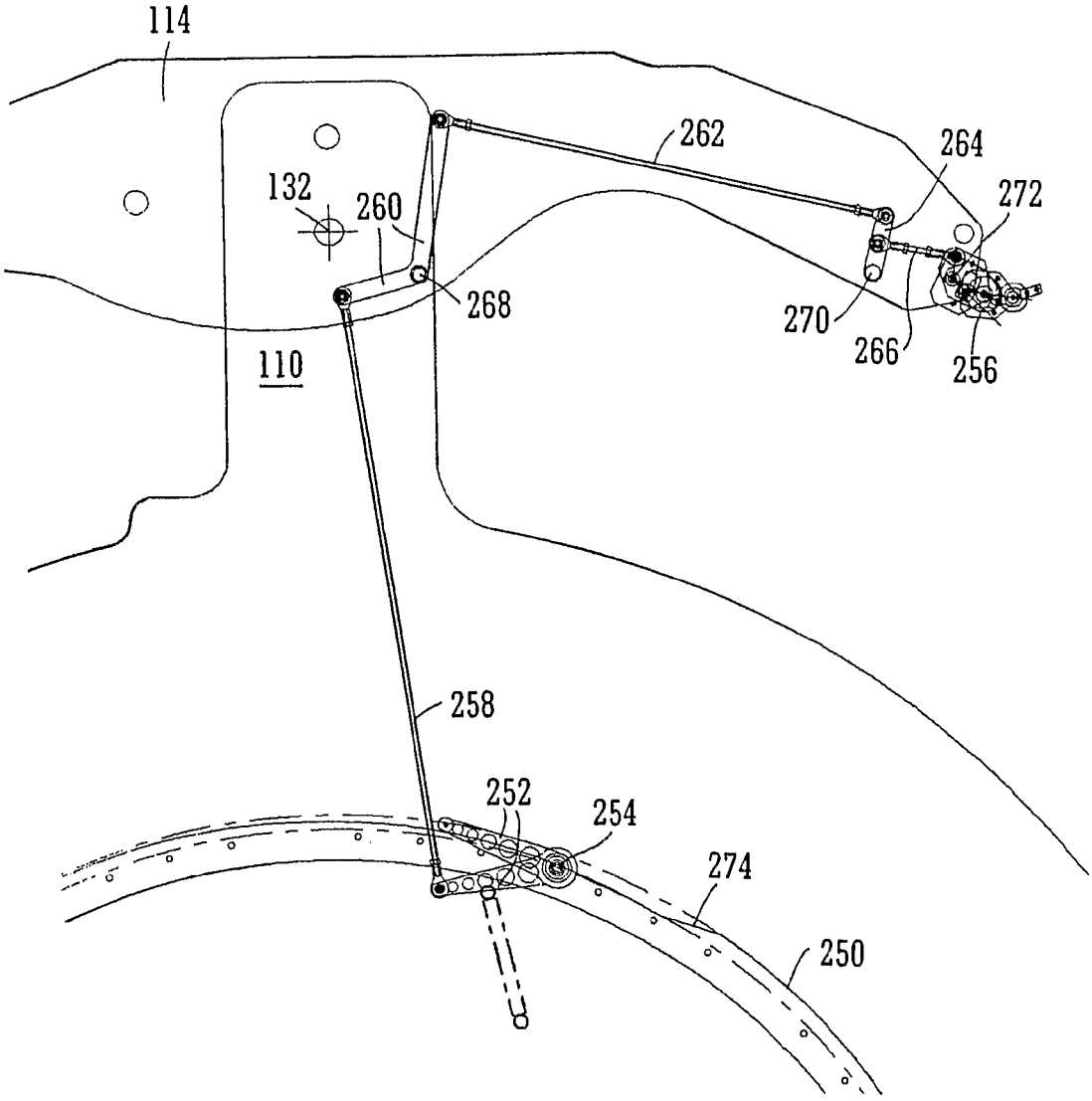

The grasshopper covering the pallet carrier 114 and pallets 150 and 152 is shown in more detail in FIGS. 10-1 and 10-2. FIG. 10-1 shows a mechanism that causes the grasshopper's lower jaw to snap upwardly once every minute, in this embodiment between the $59^{th}$ and $60^{th}$ second of every minute and then slowly open. FIG. 10-2 shows a mechanism that causes the grasshopper's tail to perform a stinging action once every quarter hour, in this embodiment between the $59^{th}$ and $60^{th}$ second of each $14^{th}$, $29^{th}$, $44^{th}$ and $59^{th}$ minute and then slowly droop down.

Referring now to FIG. 10-1 a cam 220 is mounted to escapewheel 72 (not shown in FIG. 10-1), so that the cam 220, in use, rotates together with the escapewheel 72. A cam follower 222 is pivotally mounted to base plate 110 at pivot point 224. Cam follower 222 is connected to jaw 226 through rods 228, 232 and 234 and through L-shaped bracket 230. L-shaped bracket 230 is pivotally mounted to pallet carrier 114 at pivot point 236. Jaw 226 is pivotally mounted to pallet carrier 114 at pivot point 238. Cam follower 222 is pressed against cam 220 under the influence of gravity acting on the jaw 226 and transmitted to cam follower 222 through rods 228, 232 and 234 and L-shaped bracket 20 230.

Cam 220 comprises a single step 240 along its inner circumference, in this embodiment causing the jaw to snap shut between the $59^{th}$ and $60^{th}$ second of every minute and then slowly open.

Referring now to FIG. 10-2, a cam 250 is provided connected to 'hours' shutter ring 28 (not shown FIG. 10-2). A cam follower 252 is pivotally mounted to base plate 110 at point 254 and connected to tail 256 through rods 258, 262, 264 and 266 and bracket 260. Bracket 260 30 is pivotally mounted to pallet carrier 114 at point 268. Rod 264 is pivotally mounted to pallet carrier 114 at point 270. Tail 256 is pivotally mounted to pallet carrier 114 at pivot point 272.

Cam 250 comprises four slopes 274 equidistantly spaced from each other around the outer circumference of cam 250, in this embodiment causing the sting to erect between the $59^{th}$ and $60^{th}$ second of each $14^{th}$, $29^{th}$, $44^{th}$ and $59^{th}$ minute and then slowly droop down.

Function of the Preferred Clock

Having described the structure of a preferred clock and of the preferred sub-systems, the function of this preferred clock will be described in more detail in the following.

Referring to FIG. 6, servo motor 60 continuously drives crank 62 via drive precision toothed belt 64. Gear wheel 62-A of crank 62 meshes with gear wheel 66-A of spring device 66 and continuously winds up spiral spring 66-B. Spiral spring 66-B rotates gear wheel 66-C, which in turn rotates escapewheel 72 through gear wheel 68 when escapewheel 72 is free to rotate.

As can be seen from FIGS. 5 and 9, the teeth 74 of escapewheel 72 are contacted by faces 172 and 194 of front pallet 150 and the rear pallet 152 respectively. This contact between front and rear pallets 150 and 152 with teeth 74 of escapewheel 72 can prevent rotation of escapewheel 72. Spring 66 can accordingly only rotate escapewheel 72 when front and rear pallets 150 and 152 permit such rotation.

Referring again to FIG. 6, it can be seen that crank 2 is connected to rod 76. Motor 60 continuously drives crank 62 via precision toothed drive belt 64 and thus a continuous right-left oscillating motion is imparted onto rod 76 by crank 62.

Referring now to FIG. 8, it will be appreciated that this oscillating motion is transmitted to arm 116, causing it to perform a rotationally reciprocating movement about pivot point 118. This motion is transmitted to arm 128 through rod 126 and causes rod 216 to rotationally oscillate about pivot point 132 together with pallet carrier 114.

The pitch circle diameters of the precision toothed outer surface of crank 62 for contacting drive belt 64 and of the of the precision toothed outer contact surface of motor 60 are such that crank 62 performs normally a nominal full revolution once every two seconds. Thus, it will be appreciated that pallet carrier rocks from the position shown in FIG. 8 to a position in which the left side (the grasshopper's head) of pallet carrier 114 is closest to escapewheel 72 and back once every two seconds.

It will be appreciated that, as pendulum 112 is also connected to rod 116 through rod 120, virtual pendulum 112 also performs a full period once every two seconds in synchronism with pallet carrier 114.

Now, it will be recalled that crank 62 drives cams 154 and 156 via drive belt 78. Cams 62, 154 and 156 are arranged so that one revolution of cam 62 results in one revolution of cams 154 and 156, i.e. one revolution every two seconds. Cams 154 and 156 rotate in the clockwise direction.

Cams 154 and 156 are shaped so that they (in combination with the rocking motion of pallet carrier 114) contact surfaces 172 and 194 of pallets 150 and 152 alternately align the pallet faces with the tips of teeth 74 of escapewheel 72 which determines the movement of the escape wheel 72.

FIG. 9-1 shows the condition in which the pallet carrier 114 is in its counter clockwise-most rotational position. In this position, the pallet face 172 of front pallet 150 has just become aligned with a tooth 74 of the escapewheel 72, and has pushed the tooth slightly anticlockwise. The rear pallet 152 is still just in contact with its adjacent tooth 74.

As the, pallet carrier 114 and the cams 154, 156 now rotate clockwise, the rear pallet 152 is lifted away from its adjacent tooth 74 by the cam follower 180 rising out of the trough in the rear pallet cam 156. This movement is quite rapid due to the slope of the trough face.

The combined motion of the pallet carrier 114 and the front pallet cam 154 cause the face 172 of the front pallet 150 to circumscribe a circular path along the pitch circle of the escapewheel teeth 74. The adjacent escapewheel tooth 74 remains in contact with the pallet face 172 throughout this movement by virtue of the biasing action of the spiral spring device 66.

This movement continues until the position shown in FIG. 9-2 where the pallet 114 is in its clockwise-most position. In this position, the rear pallet 152 once more drops back down into contact with an escapewheel tooth 74, again moving the tooth 74 slightly in a counter clockwise direction. Counter clockwise rotation of the pallet carrier 114 and rotation of the pallet cams 154, 156 then causes the front pallet to be lifted out of contact with its adjacent tooth 74, the movement of the rear pallet face 194 then being along the circular path defined by the pitch circle of the escapewheel teeth 74. This allows the escapewheel 72 to rotate under the torque of the spring device 66.

This mechanism therefore allows the intermittent movement of the escapewheel 72, which in turn drives the rotatable seconds shutter 24 through one sixtieth of a rotation per second.

At the positions shown in FIGS. 9-1 and 9-2, the shutter ring 24 is stationary. In this condition, a slit 30-0 of the 'seconds' rotating shutter ring 24 is in alignment with the aperture 17-1 of the fixed shutter ring 16, allowing a particular second to be indicated through the aligned slot 10 on the clock face.

The escapewheel 72 (and thus the shutter ring 24) perform one sixtieth of a rotation per second. During this rotation, slit 30-0 on rotatable shutter ring 24 moves from alignment with a aperture 17-1 on the static aperture plate 15 into alignment with the immediately adjacent aperture 17-2 in the clockwise direction such that the next second is indicated through the appropriate aligned slot 10 in the clock face. Thus the illuminated slot 10 moves around the clock face at the rate of one slot 10 per second.

In view of the fact that the shutter rings 24, 26 and 28 having e.g. sixty-one equidistantly spaced slits 30-0 to 30-60, an interesting visual effect is also achieved.

In particular, during each 6° rotation of the shutter ring 24, the slits 30-2, 30-3, 30-4 etc will sequentially, and for a very brief period of time only, become aligned with static apertures 17-2, 17-3, 17-4 and so on. This will cause the effect of a band of light racing around the clock face each second.

Rotation of the 'seconds' shutter ring 24 causes rotation of the 'minutes' ring 26 and 'hours' ring 28 by the mechanisms described above, and the movement of slits in the rotating shutter rings into alignment with the apertures in the static aperture plates causes illumination of the particular minute, quarter hour or hour as appropriate, with a racing light band effect similar to that occurring on the second ring occurring.

To improve the display of a particular second or minute, it is possible to blank off slits 30-1 and 30-60 and slits 32-1 and 32-60 in the rotatable shutter rings 24, 26. In this way, a small movement of the rotatable shutter rings will not illuminate an adjacent slot in the clock face. Moreover, the slits 30-0 and 32-0 may be made wider than the adjacent slits, for example three times wider, to improve the display.

Movement of the Grasshopper's Jaw and Tail

As described above, cams 220 and 250 and cam followers 222 and 252 cause jaws 226 and tail 256 perform a snapping and stinging action. The jaw performs the snapping action once every minute while the tail performs the stinging action once every quarter hour.

Special Operation Modes

The preferred clock 2 lends itself to a variety of special operation modes, some of which will now be described.

It will be appreciated that the time keeping precision of clock 2 depends on the speed of motor 60 being constant. If it is desired to let time appear to pass more slowly the motor 60 can be driven more slowly and if it is desired to let time appear to pass more quickly the motor 60 can be driven more quickly. This can be used to illustrate the passage of time in unusual manners. The average speed of clock 2 can of course be chosen to be the correct speed for accurate time keeping with the clock coming out of phase but always arriving back in phase a predetermined particular time eg on the zero second of every particular minute or say every 5 minutes for more extreme excusions.

In a further special operations made clock 2 can be made to run backwards. To achieve this motor 60 is run in the counter-clockwise direction. It will be appreciated that this reversal in the running direction of motor 60 causes a change in the movement pattern of pallets 150 and 152. When motor 60 is operated in reverse pallets 150 and 152 approach the tips of teeth 74 of escapewheel 72 and, aided by the rocking motion of pallet carrier 114, push against teeth 74 so as to rotate escapewheel 72 in the counter-clockwise direction. Accordingly, the clock 2 runs 'backwards'. It will be appreciated that the counter-clockwise rotation of escapewheel 72 still requires the continuous drive of the motor 60 to be taken up as intermittent motion of the escapewheel so that the spring 66 performs the same function as when the clock runs forwards.

Switching of the clock from the normal running/operation mode in which it correctly displays time to the "backwards" running mode can be achieved without causing any signs other than reversal of time display if the running direction of motor 60 is reversed when crank 62 is in the position shown in FIG. 8 or rotated by 180 degrees from that position. When crank 62 is in either of these two positions both pendulum 112 and pallet carrier 114 are at one of the extreme points of their motion and their movement is accordingly restricted to a movement back towards the centres of their swings, irrespective of the direction of movement of motor 60.

It has previously been mentioned that rod 126 (shown in FIG. 8) comprises an element 130 for 20 adjusting its length. In a normal operation mode the length of rod 126 and element 130 is chosen so that contact between contact faces 172 and 194 of pallets 150 and 152 is made in an accurate fashion so that noise is minimised. If the length of rod 126 and element 130 is 25 chosen so that the amplitude of the rocking motion of pallet carrier 114 is larger to one side than to the other then the noise made by clock 2 changes. In particular, contact between the contact face 172 to 194 of the pallet 150 or 152 located on the side of the 30 pallet carrier 114 that has the larger amplitude of motion an a tooth 74 of escapewheel 72 will be more abrupt, and accordingly louder, than contact between the other contact face 172 or 194 and a tooth 74. The noise pattern produced by clock 2 can accordingly be adjusted.

The clock 2 can further be designed so that the band of light running around the rings of slots 4, 6 and 8 run in the counter-clockwise direction. To achieve this effect, the number of slits provided in 'seconds', 'minutes' and 'hours' shutter rings 24, 26 and 28 needs to be one less than the number of apertures provided in static aperture plates 15 and 16 respectively, so that the angular spacing between the slits in the shutter rings 24, 26 and 28 is larger than the angular spacing between the corresponding apertures in the static aperture plates 15 and 16. Applied to a configuration in which sixty slots slits are provided in static aperture plate 16 for each the display of seconds and for the display of minutes, providing, for example, fifty-nine equiangularly spaced slits in 'second' and 'minutes' shutter rings 24 and 26 permits generating a backwardly running band of light. Providing forty-seven equiangularly spaced slits in 'hours' shutter ring 28 allows achieving the same effect for the display of hours and quarter hours if the static aperture plate 15 used in the above discussed embodiment is also employed.

Although the present invention has been described with reference to a preferred embodiment, it will be understood by those skilled in the art that many changes in form and detail may be made, and in particular other types of escapement, pendulum or balance wheel could be used without departing from the scope of the invention as set forth in the accompanying claims.

Figure 11:
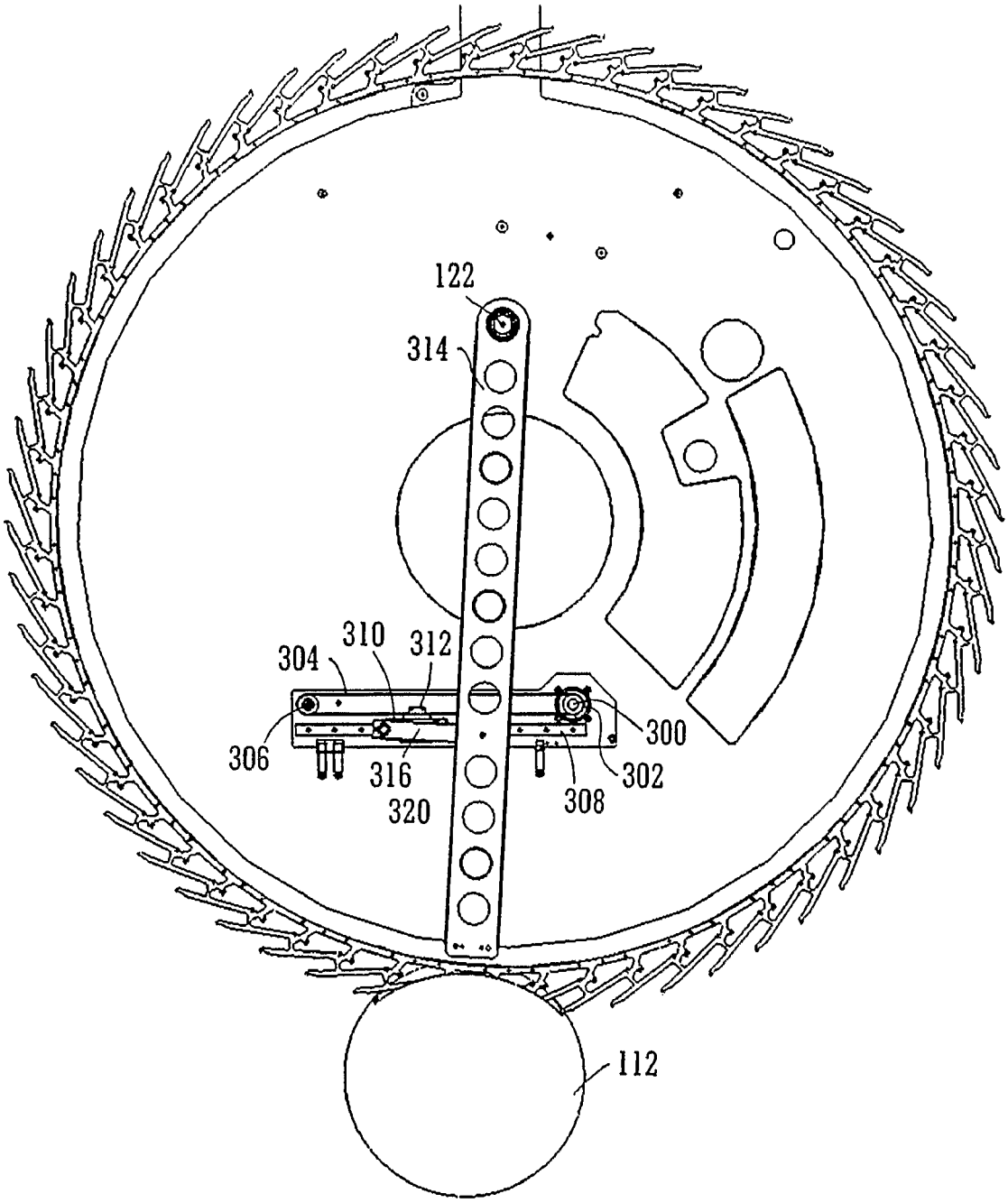
FIG. 11 shows a pendulum drive mechanism.

For example, in another embodiment the pendulum 112 may be driven separately from the escapement. Referring to FIG. 11, the pendulum 112 is driven by a motor 300 which drives a pulley 302 through a gearbox not shown. A drive belt 304 passes around the pulley and an idler pulley 306. A guide rail 308 is mounted below the drive belt and supports a carriage 310 for reciprocating movement along the guide rail. The carriage 310 is attached to the guide belt 304 by a fixing block 312. The pendulum arm 314 is attached to the carriage by a link arm 316 which is pivoted to the carriage by pivot 318 and to the pendulum 314 by pivot 320. Sensors (not shown) linked to the motor control are provided to prevent the pendulum from moving too far in either direction.

This drive arrangement had advantages over the arrangement described above in that it allows both the speed and the amplitude of the pendulum swing to be controlled. Moreover, the effects of inertia on the drive mechanism are minimised.

The pendulum drive motor is controlled by the control system of the clock which means that the control system may drive the pendulum in a perfectly conventional manner, i.e. with a constant amplitude and sinusoidal speed, this being synchronised with the escapement by the control system. However, it does allow for the pendulum to be moved in other ways. For example, the amplitude of swing may be varied over the number of swings, for example decreasing to zero and then increasing again, the speed of the swing could be increased in every oscillation, for example, thus moving more slowly towards the centre of the swing and faster towards the outer part of the swing. The pendulum could be stopped at any point in the swing and started again after a given delay, for example half a cycle. Moreover, the position of the swing may be changed so that swing is off centre. The swing may be in time with the rest of the clock motion in opposition or lagging 30 behind it by a desired amount. The pendulum could even move in a completely random manner.

Figure 12:
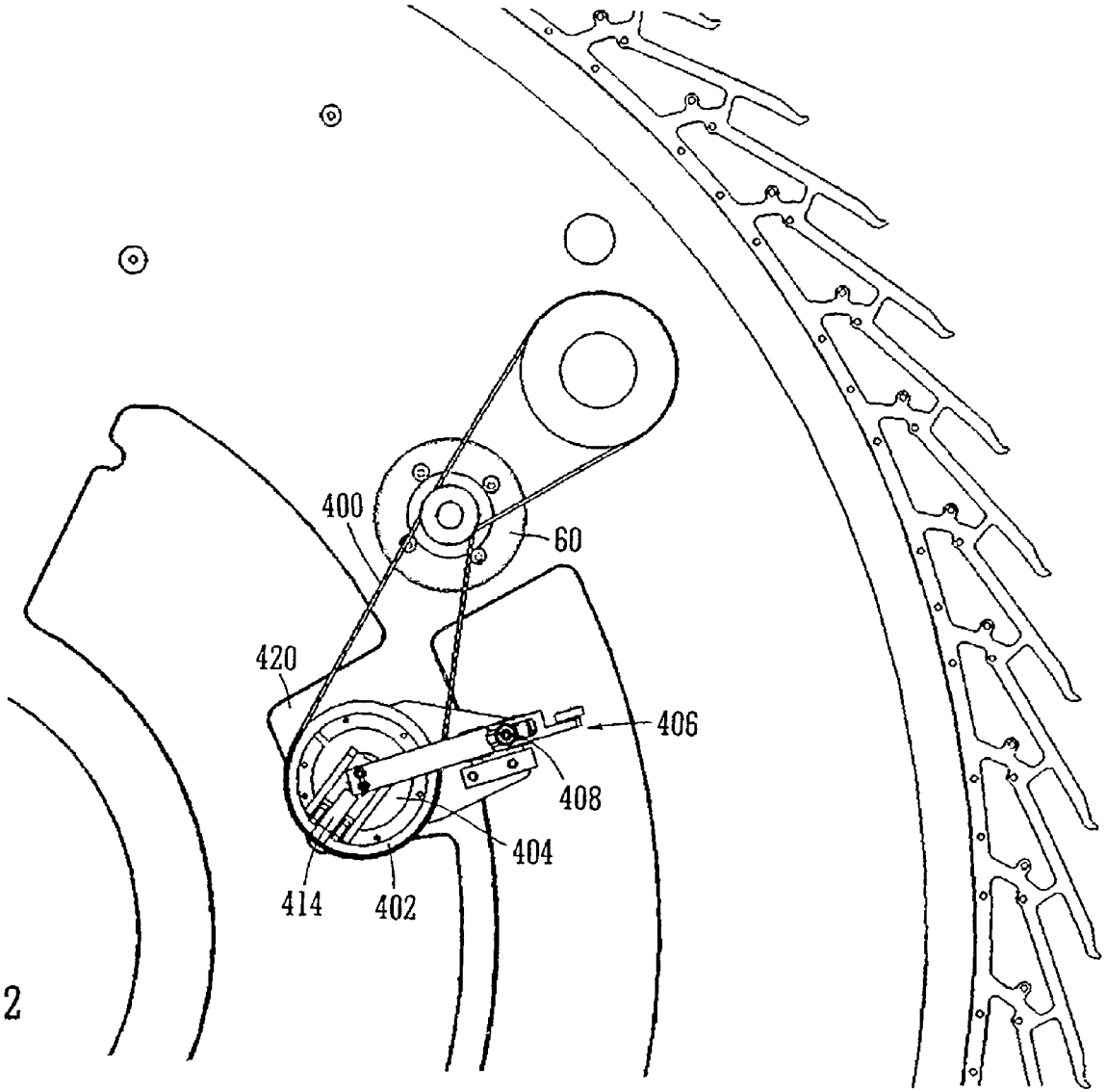
FIG. 12 shows a striking mechanism.
Figure 13:
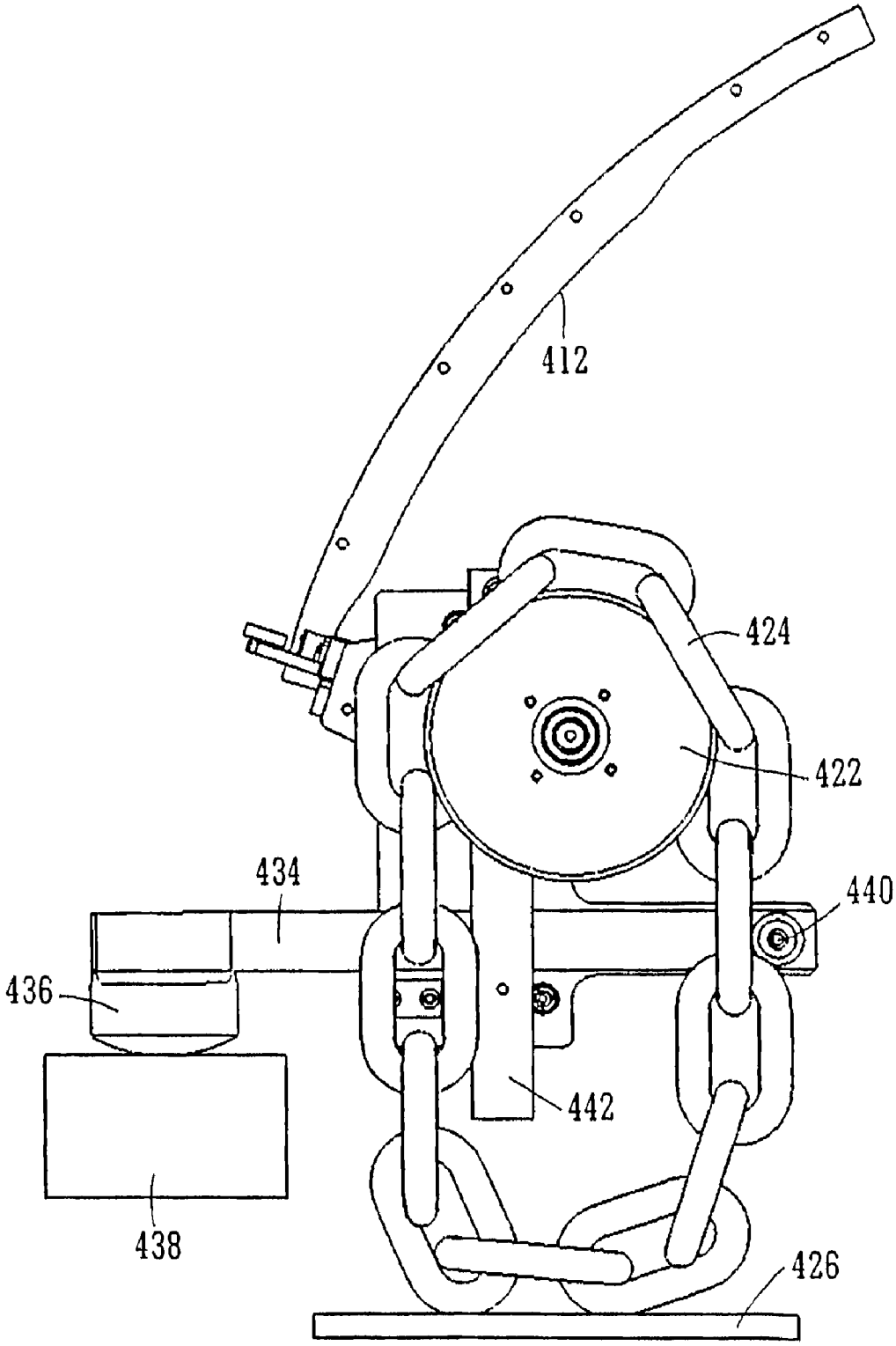
FIG. 13 shows the striking mechanism of FIG. 12 from a different direction.
Figure 14:
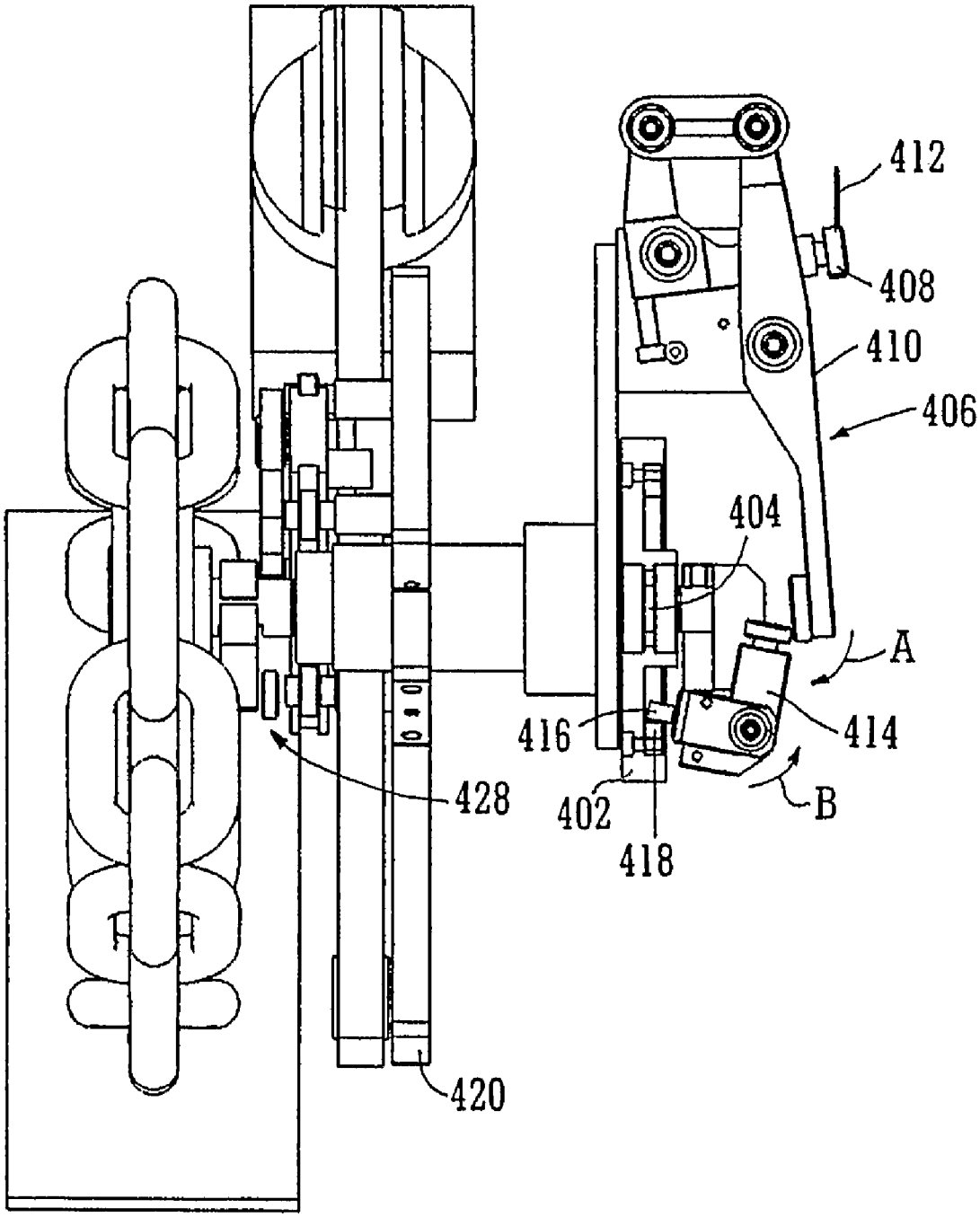
FIG. 14 shows the striking mechanism from a further direction.

A strike mechanism may be incorporated into the clock. An embodiment of such a strike mechanism is described in FIGS. 12 and 13.

In this embodiment, a further drive belt 400 is taken from the main drive motor 60. The drive belt engages a pulley 402 which is rotatably mounted on a strike shaft 404. The pulley 402 freewheels on the strike shaft 404 except when it is selectively engaged to the strike shaft by an engagement mechanism 406. The engagement mechanism 406 comprises a roller 408 mounted on the end of a lever arm 410 which engages with a cam 412 which is provided facing inwardly on the minutes ring. The cam engages with the wheel 408 only over a relatively short period of time, for example for 2 to 3 minutes on the hour every hour. When the cam 412 engages the wheel 408, it pivots the lever arm 410 in the direction of arrow A which in turn pivots a rocker arm 414, which is attached to rotate with the strike shaft 404, in the direction of arrow B. The rocker arm 414 has a drive pin 416 at one end which, when the rocker arm is so pivoted, will engage with a drive slot 418 provided the pulley 402 such that the pulley will then drive the strike shaft 404 and the strike shaft 404 and pulley 402 will rotate together.

The strike shaft 404 passes through a body plate 420 of the clock and is provided with a pulley 422 over which is engaged a chain 424. A striking plate 426 is arranged below the chain 422. A sprag clutch 428 is provided between the strike shaft 404 and the pulley 422 such that the latter only turns when the strike shaft 404 rotates backwardly.

Figure 15:
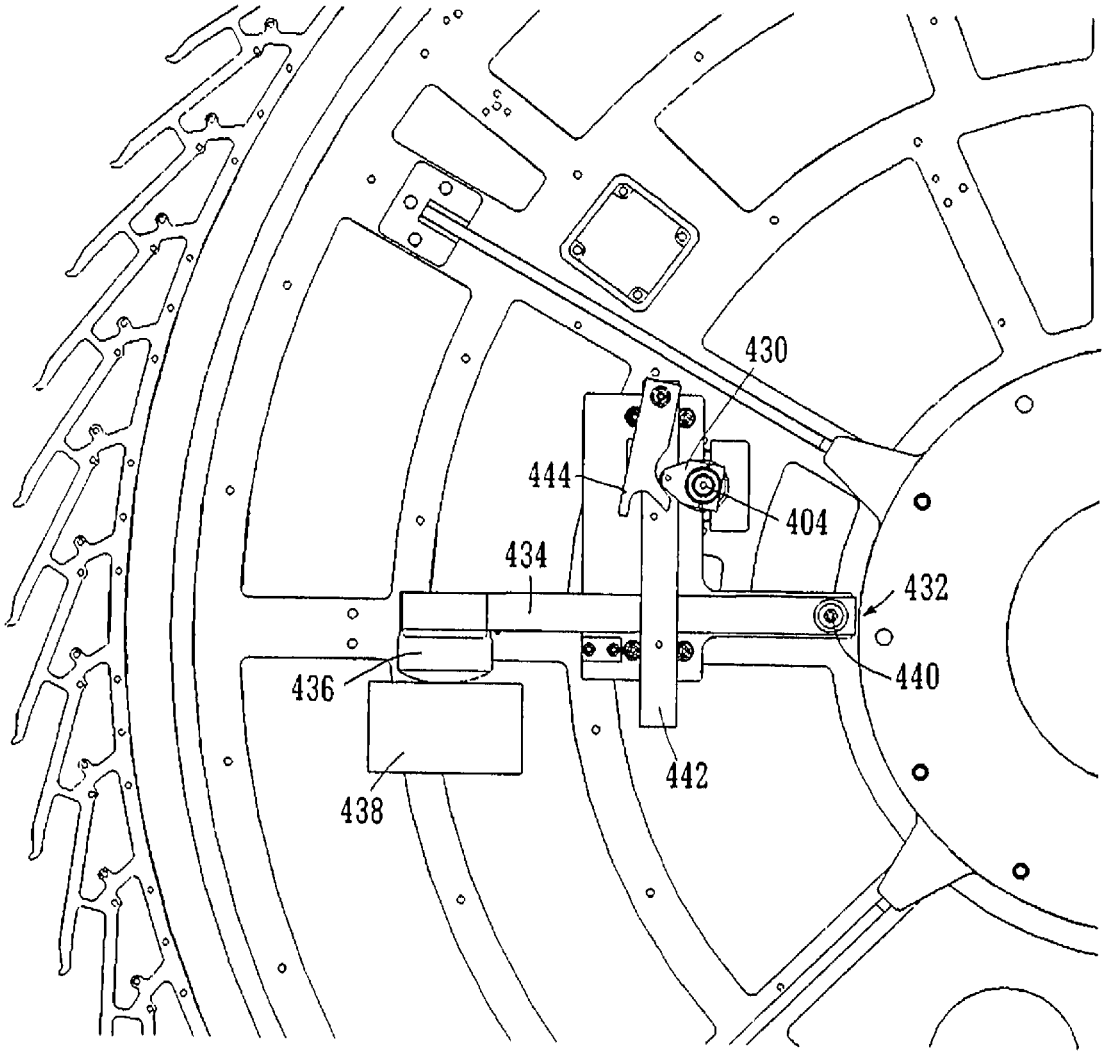
FIG. 15 shows a view similar to FIG. 13 but with certain components removed for clarity.

The strike shaft 404 is provided with a lug 430 which operates a striking mechanism 432. The striking mechanism 432 comprises a striking arm 434 with a striking head 436 which strikes against a strike block 438. The strike arm 434 is pivotably mounted about a pivot 440 at one end and is operated through a lifting arm 442. The lifting arm 442 is mounted to move upwardly and downwardly and has a pin not shown which engages the underside of the strike arm 434 to lift the strike arm 434. The upper end of the lifting arm 442 is provided with a pivotally mounted pawl 444 for engagement with the lug 430. When the strike shaft 404 rotates anti-clockwise in the sense of FIG. 15, the pawl 444 is simply pushed out of the way by the lug 430 and the lifting arm 442 does not move. However, when the strike shaft rotates clockwise in the sense of FIG. 15, the pawl 444 is engaged by the lug 430, lifting the lifting arm 442 until such time as the lug 430 moves out of engagement with the pawl 444 which will cause the lifting arm 442 and thus the striking arm 434 to drop, thereby dropping the striking head 436 against the strike block 438.

In operation, therefore, when the clock is to strike, at the hour or whenever required, the engagement mechanism 406 engages the pulley 402 with the strike shaft 404 so that the strike shaft 404 rotates. While the clock is being driven in its normal, forward state, although the strike shaft 404 rotates, that movement is not transmitted either to the striking arm 434 (as the lug 430 does not catch on the pawl 444) or the chain pulley 422 due to the sprag clutch not engaging. However, when the clock reaches the hour the drive motor 60 begins to run backwardly which then causes the sprag clutch to engage thereby rotating the chain pulley 422 such that the chain 424 rotates and rattles against the rattle plate 426. The lug 430 also engages the pawl 444 as described above which will cause the striking head 436 to lift and drop as described above. The number of strikes can be controlled by running the drive backwards and forwards. For example, on reaching the hour, the drive may reverse for a predetermined period, for example 1 second, then drive forward for a further time, for example 1 second, then reverse again, repeating this for the number of times required. During each second of reverse drive the chain 424 rattles and the clock strike.

While in the embodiment of the invention described above the seconds dial is shown as having sixty seconds, and the pendulum typically swings once per second, the person skilled in the art will recognise that these are not essential features of the invention. For example in a larger clock, where the mass and inertia of the pendulum may be substantial, the pendulum may swing more slowly with swings of 2 or more seconds. This can be accommodated with different effects. For example with each 2 second swing of the pendulum, a seconds ring with 60 divisions can give 2 revolutions of flashing lights before pausing at a 2 second division at the end of the pendulum swing and then racing round twice more before pausing again at then other end of the pendulum swing. It is equally possible to slow the lights down so they only perform a single, half speed revolution within a two second pendulum swing.

Similarly half second, rather than second divisions on the dial would produce a more pleasing effect with a pendulum or balance wheel beating in half seconds. Only the method of producing narrow enough apertures in the dial and the accuracy of the mechanism would limit such an arrangement, particularly if individual lights are not used but mirrors, light pipes or reflected light.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A clock comprising a static surface with a number of narrow apertures, each corresponding to a representation of an instant of time in a predetermined unit, and a rotatable shutter with a number of narrow apertures arranged so that light propagating through a selected one of the apertures in the rotatable shutter can also propagate through one of the apertures in the static surface so as to indicate said instant of time;

wherein the number of apertures in the rotatable shutter differs from the number of apertures in the static surface; and further comprising means for rotating the rotatable shutter from a position in which said one of the apertures in the rotatable shutter is in alignment with one of the apertures in the static surface to a position in which the same one of the apertures in the rotatable shutter is in alignment with an adjacent one of the apertures in the static surface when incrementing the instant of time indicated by one unit.

2. The clock as claimed in claim 1, wherein said unit of time is a second, a minute, a quarter hour, an hour, a 25 half day, a day, a week, a month or a moon phase.

3. The clock as claimed in claim 1, wherein the apertures in the static surface or in the shutter are elongate.

4. The clock as claimed in claim 1, comprising apertures in the static surface for indicating seconds, apertures in the static surface for indicating minutes, a shutter ring associated with the apertures for indicating seconds and a shutter ring associated with the apertures for indicating minutes;

wherein said shutter ring associated with the apertures for indicating minutes is indexed, in use, to move from indicating a minute to indicating the next minute when the shutter ring for indicating seconds is indexed forward from indicating a last second of a minute to indicating a first second of a next minute.

5. The clock as claimed in claim 1, comprising apertures in the static surface for indicating minutes, apertures in the static surface for indicating hours, a shutter ring associated with the apertures for indicating minutes and a shutter ring associated with the apertures for indicating hours;

wherein said shutter ring associated with the apertures for indicating hours is indexed, in use, to move from indicating an hour to indicating the next hour when the shutter ring for indicating minutes is indexed forward from indicating a last minute of an hour to indicating a first minute of a next hour.

6. The clock as claimed in claim 1, comprising a plurality of concentric rotatable shutters.

7. The clock as claimed in claim 6, wherein the shutters are arranged to be independently driven.

8. The clock as claimed in claim 6, wherein a first one of the shutters is arranged to be independently driven.

9. The clock as claimed in claim 8, wherein the first shutter is arranged to drive other shutters.

10. The clock as claimed in claim 8, wherein the first shutter is arranged to be driven by an escapement.

11. The clock as claimed in claim 8, wherein said first shutter is associated with apertures for indicating seconds in a static face of the clock.

12. The clock as claimed in claim 8, further comprising means for locking non-moving shutters during periods of non-movement.

13. The clock as claimed in claim 8, wherein the first shutter is arranged to intermittently drive a further shutter.

14. The clock as claimed in claim 8, wherein a further shutter driven in use, by the first shutter includes a ring gear that engages a gear wheel that is, in use, directly or indirectly driven by said first shutter.

15. The clock as claimed in claim 14, wherein the gear wheel is driven, in use, by a further gear wheel which engages or is engageable by the first shutter.

16. The clock as claimed in claim 14, wherein the first shutter is provided with teeth over a limited circumferential extent, whereby drive is only transmitted to a further shutter, in use, over a limited circumferential movement of the first shutter.

17. The clock as claimed in claim 8, further comprising means for selectively drivingly coupling the first shutter to a further shutter.

18. The clock as claimed in claim 17, wherein said means for selectively coupling comprises a cam which at a predetermined rotational position of the first shutter engages a cam follower associated with a drive, thereby selectively drivingly coupling said first shutter to a further shutter.

19. The clock as claimed in claim 1 wherein a shutter is associated with a number of slots in the static face of the clock, the slots representing a predetermined unit of time;

wherein the shutter is arranged to perform a full rotation in a period of time defined by the number of slots in the static surface multiplied by the unit of time represented by the slots in the static surface.

20. The clock as claimed in claim 1 wherein the apertures in the static surface and in the shutter are arranged in a circle and extend in a radial direction.

21. The clock as claimed in claim 20, wherein a diameter of a circle in which the centres of the apertures in the static surface are arranged is similar or substantially the same as a diameter of a circle in which the centres of the apertures in the rotatable shutter are arranged.

22. The clock as claimed in claim 20, wherein the apertures are slits.

23. The clock as claimed in claim 22, wherein the width of each aperture is less than the circumference of a circle formed by the inner edges of the apertures divided by the number of apertures squared.

24. The clock as claimed in claim 1, wherein seven, twelve, thirty one, forty-eight or sixty apertures are provided in the static surface.

25. The clock as claimed in claim 1, wherein a number of apertures in the static surface of the clock differs from the number of apertures in a shutter associated with the said apertures in the static surface by one.

26. The clock as claimed in claim 25, wherein the number of apertures in the shutter is greater than the number of apertures in the static surface.

27. The clock as claimed in claim 1, further comprising a light source.

28. The clock as claimed in claim 27, wherein a said shutter is arranged between the light source and the static surface.

29. The clock as claimed in claim 1, comprising an outer face with apertures aligned with the apertures in the static surface.

30. The clock as claimed in claim 29, wherein the apertures in the static surface are rectangular slits.

31. The clock as claimed in claim 29, wherein the 20 apertures in the outer face have a lenticular slope.

32. The clock as claimed in claim 29, wherein the apertures in the static surface are narrower than the apertures in the outer face.

33. The clock as claimed in claim 1, wherein apertures in an outer face of the clock accommodate light pipes for conveying light through the outer face.

34. The clock as claimed in claim 33, wherein a front face of a said light pipe forms a continuous surface with the outer face of the clock.

35. The clock as claimed in claim 33, wherein a said light pipe has a frosted appearance.

36. A clock comprising a static surface with a number of apertures each corresponding to a representation of an instant of time in a predetermined unit, and a rotatable shutter with a number of apertures arranged so that light propagating through at least one of the apertures in the shutter can also propagate through one of the apertures in the static surface;

wherein the rotatable shutter is arranged to perform one full rotation in a period defined by the number of apertures in the static surface displaying the unit of time multiplied by the unit of time associated with the apertures in the static surface; and wherein the number of apertures in the static surface differs from the number of apertures in the rotatable shutter.

37. The clock as claimed in claim 36, wherein the clock is arranged so that, in a process of rotating the rotatable shutter from alignment of an aperture in the rotatable shutter with an aperture in the static surface into alignment of the said aperture in the shutter with an adjacent aperture in the static surface, all of the apertures in the static surface are sequentially aligned with a corresponding aperture in the shutter for a 5 period of time.

38. The clock as claimed in claim 36, wherein a rotatable shutter is coupled to an escapement.

39. The clock as claimed in claim 38, further comprising a pair of pallets and a pallet carrier for, in use, controlling the rotation of the escapement.

40. The clock as claimed in claim 39, wherein the pallets are arranged to, in use, be positively driven into and out of alignment with the escapement.

* * * * *